US006580227B2

(12) United States Patent
Kobayashi

(10) Patent No.: US 6,580,227 B2
(45) Date of Patent: Jun. 17, 2003

(54) PLASMA DISPLAY PANEL, MANUFACTURING METHOD THEREOF, AND PLASMA DISPLAY

(75) Inventor: Koji Kobayashi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/112,725

(22) Filed: Apr. 2, 2002

(65) Prior Publication Data

US 2002/0140365 A1 Oct. 3, 2002

(30) Foreign Application Priority Data

Apr. 3, 2001 (JP) ..... 2001-104385

(51) Int. Cl.[7] ..... H05B 37/00
(52) U.S. Cl. ..... 315/169.4; 345/76
(58) Field of Search ..... 315/169.3, 169.4; 345/76, 77, 78, 79

(56) References Cited

U.S. PATENT DOCUMENTS 4,414,490 A * 11/1983 Harvey ..... 315/169.4

FOREIGN PATENT DOCUMENTS

JP 11-67100 A 3/1999

JP 2000-243299 A 9/2000

OTHER PUBLICATIONS

N. Kosugi et al., "Reduction of background emission at the set–up period of AC–PDP using ramp waveform", The Technical Report of The Proceeding of The Institute of Electronics, Information and Communication Engineers, vol. EID 98–95, (Jan. 1991), pp. 91–96 with English Abstract.

* cited by examiner

*Primary Examiner*—David Vu
(74) *Attorney, Agent, or Firm*—Sughrue Mion, PLLC

(57) ABSTRACT

A mesh barrier rib structure to separate display cells is provided, and each of the display cells is completely separated from the adjacent cells. Bus electrodes are provided to overlap transparent electrodes. The bus electrodes are for example made of a layered body including a white Ag thin film and a black $RuO_2$ thin film. The transparent electrode and the bus electrode form a scan electrode, while the transparent electrode and the bus electrode form a common electrode. The bus electrodes are provided in the closest positions to the surface discharge gap between the transparent electrodes. Therefore, priming discharge is generated in the vicinity of the discharge gap, and light emission can be restrained in the priming period.

57 Claims, 28 Drawing Sheets

PLASMA DISPLAY PANEL, MANUFACTURING METHOD THEREOF, AND PLASMA DISPLAY

BACKGROUND OF THE INVENTION

1. Field of the Invention

The present invention relates to a plasma display panel suitably used for a flat display panel, a manufacturing method thereof, and a plasma display. The present invention more specifically relates to a plasma display panel with improved contrast, a manufacturing method thereof, and a plasma display.

2. Description of the Related Art

There are two kinds of plasma display panels (PDPs), AC type and DC type PDPs. The AC type PDP has electrodes covered with dielectric because of the operating method and is indirectly operated in an AC discharge state. The DC type PDP has electrodes exposed in a discharge space and is operated in a DC discharge state. The AC type plasma displays are divided based on the driving method into a memory operation type using display cell memories, and a refresh operation type that does not use memories. Note that the luminance by the plasma display is in proportion with the number of discharge. The refresh type display whose luminance is reduced for an increased display capacity is mainly used for a plasma display with a small display capacity.

FIG. 1 is a perspective view of a single display cell in an AC type plasma display panel. FIGS. 2A and 2B are a plan view and a sectional view, respectively showing in detail the shapes of a scan electrode and a common electrode in a conventional plasma display panel.

A display cell is provided with two insulating glass substrates 101 and 102. The insulating substrate 101 is to be a back panel substrate, while the insulating substrate 102 is to be a front panel substrate.

Transparent electrodes 103 and 104 are provided on the surface of the insulating substrate 102 facing the insulating substrate 101. The transparent electrodes 103 and 104 extend in the horizontal direction of the panel (in the horizontal direction). Bus electrodes 105 and 106 are provided to overlap the transparent electrode 103 and the common electrode 104, respectively. The bus electrodes 105 and 106 are each for example a thin film electrode of CrCu or Cr having a thickness from 1 $\mu$m to 4 $\mu$m. The bus electrodes are provided to reduce the electrode resistance values between the electrodes and externally provided drives. The transparent electrode 103 and the bus electrode 105 form a scan electrode 115, while the transparent electrode 104 and the bus electrode 106 form a common electrode 116. Within one display cell, the bus electrodes 105 and 106 are provided in the furthermost positions from the surface discharge gap between the transparent electrodes 103 and 104. There are a dielectric layer 112 to cover the transparent electrodes 103 and 104 and a protection layer 114 of magnesium oxide or the like to protect the dielectric layer 112 against discharge.

There is a data electrode 107 perpendicular to the scan electrode 103 and the common electrode 104 on the surface of the insulating substrate 101 facing the insulating substrate 102. The data electrode 107 therefore extends in the vertical direction of the panel (the vertical direction). There are barrier ribs 109 to divide display cells in the vertical direction. A dielectric layer 113 to cover the data electrode 107 is provided. A phosphor layer 111 to convert a ultraviolet beam generated by gas discharge into a visible light beam 110 is formed on the side of the barrier rib 109 and the surface of the dielectric layer 113. A discharge gas space 108 is secured by the barrier ribs 109 in the space between the insulating substrates 101 and 102. Then, a helium, neon, or xenon gas, or a mixture gas thereof as a discharge gas is filled in the discharge gas space 108.

In the plasma display panel as described above, when the potential difference between the scan electrode 115 and the common electrode 116 is above a prescribed value, discharge is generated, and light emission 110 is caused accordingly.

Writing selective type driving operation in the conventional plasma display panel as described above will now be described. FIG. 3 is a timing chart for use in illustration of the writing selective type driving operation in the conventional plasma display panel. Each sub field consists of four periods, a priming period, an address period, a sustaining period, and a charge erasure period. These four periods are sequentially set.

In the priming period, a saw-toothed priming pulse Ppr-s is applied to the scan electrode, and a rectangular waveform priming pulse Ppr-c is applied to the common electrode. The priming pulse Ppr-s is a pulse of the positive polarity, while the priming pulse Ppr-c is a pulse of the negative polarity. According to *The Technical Report of The Proceeding of The Institute of Electronics, Information and Communication Engineers*, vol. EID 98-95, p. 91, January 1991, the use of voltage in a ramp voltage waveform at 7.5 V/$\mu$sec or less can lower the black luminance. The smaller the gradient of the voltage, the lower is the black luminance, while at too small a gradient the time period for the voltage to reach the necessary level for priming discharge is prolonged, which prolongs the priming period. Then, the sustaining period must be shortened, and the peak luminance is lowered in the sustaining discharge, which lowers the contrast. Therefore, a voltage gradient of about 4 V/$\mu$sec is typically used.

In response to the applied priming pulses Ppr-s and Ppr-c, priming discharge is generated in a discharge space in the vicinity of the gap between the scan electrode and the common electrode. Active particles which make easier the following sustaining discharge in the cell are generated, while wall charge of the negative polarity is attached on the scan electrode and wall charge of the positive polarity is attached on the common electrode. Then, a charge control pulse Ppe-s is applied to the scan electrode. This causes weak discharge to take place, so that the wall charge of the negative polarity on the scan electrode and the wall charge of the positive polarity on the common electrode are reduced.

In the following address period, a display cell for light emission is selected, and writing discharge is generated only at a cell selected by a scan pulse Psc-s of the negative polarity applied to the scan electrode and a data pulse Pd of the positive polarity applied to a data electrode. Wall charge is attached to the electrode of the cell to emit light in the following sustaining period. When writing discharge is generated, wall charge is attached to the discharge cell. In contrast, discharge cells without writing discharge remain with little wall charge after the charge erasure.

In the following sustaining period, light emission is caused for display, a pulse starts to be applied from the common electrode side, and then sustaining pulses Psus-s and Psus-c of the negative polarity are alternately applied to the scan electrode and the common electrode, respectively. At the time, since there is extremely little wall charge at the discharge cells without writing during the address period, sustaining discharge is not generated when a sustaining pulse is applied to the discharge cells.

Meanwhile, in the discharge cell with writing discharge during the address period, the scan electrode is attached with positive charge, while the common electrode is attached with negative charge. Therefore, the sustaining pulse voltage of the negative polarity to the common electrode and the wall charge voltage are superposed on each other, the voltage across the region between the electrodes exceeds the threshold voltage for discharge, and intensified discharge is generated (hereinafter referred to as "strong discharge").

Once discharge is generated, wall discharge is provided to cancel voltage being applied to each electrode. Therefore, the negative charge is attached to the common electrode, while the positive charge is attached to the scan electrode. For the following sustaining pulse, the scan electrode side has a positive voltage pulse, and therefore effective voltage superposed with the wall charge and applied to the discharge space exceeds the threshold voltage for discharge to generate discharge. Thereafter, the same process is repeated to sustain discharge. The luminance is determined based on how many times the discharge is repeated.

In the following charge erasure period, a sustaining erasure pulse Pse-s of the negative polarity is applied to a scan electrode Si. The sustaining erasure pulse Pse-s of the negative polarity is a pulse in a saw-toothed waveform. Thus, the wall charge attached to each electrode when the previous sub field has light emission is erased. Meanwhile, the state of all the discharge cells in the panel can be equalized regardless of the presence/absence of light emission in the previous sub field.

Japanese Patent Laid-Open Publication No. Hei. 11-67100 discloses a plasma display panel including a stripe-shaped barrier rib structure. According to the disclosure, bus electrodes on the scan electrode side are positioned on the discharge gap side for reducing the power consumption.

Japanese Patent Laid-Open Publication No. 2000-243299 discloses a plasma display panel directed to prevention of discharge interference between adjacent display cells. According to the disclosure, a comb-toothed transparent electrode is provided while bus electrodes are provided on the discharge gap side.

In the conventional plasma display panels, however, the luminance when weak discharge is generated in a priming period i.e., so-called black luminance is high, and therefore sufficient contrast is not provided. FIG. 4A is a timing chart for use in illustration of the relation between the potential difference between surface discharge electrodes and the discharge intensity in a sustaining period, while FIG. 4B shows the relation in a priming period. Note that the potential difference in FIG. 4A is provided by application of one sustaining pulse. As shown in FIGS. 4A and 4B, the intensity of discharge in the sustaining period, in other words, the intensity of the sustaining discharge is extremely larger than the intensity of discharge in the priming period, in other words the intensity of the priming discharge. The contrast is represented by the ratio of the peak luminance in the sustaining period relative to the black luminance, and is substantially equal to the ratio of the intensity of the sustaining discharge relative to the intensity of the priming discharge. Therefore, the larger the light emission by the priming discharge, the lower is the contrast.

Also in the plasma display panel disclosed by Japanese Patent Laid-Open Publication No. Hei. 11-67100, the expansion of the priming discharge is large, and the black luminance is not sufficiently low. In addition, the scan electrode and common electrode are not symmetrical, and therefore the positional relation between the scan electrode and the common electrode must be constant among the display cells. This is because when for example the scan electrode and common electrode are inverted between adjacent display lines in order to narrow the non-discharge gap, the picture quality degrades with moiré or the like.

In the plasma display panel disclosed by Japanese Patent Laid-Open No. 2000-243299, the sustaining discharge does not spread over the entire display cell in order to prevent the interference between the display cells.

SUMMARY OF THE INVENTION

It is an object of the present invention to provide a plasma display panel which allows a high contrast to be obtained and preferably the sustaining voltage and threshold voltage for discharge to be reduced, so that the power consumption can be reduced, a manufacturing method thereof, and a plasma display.

The plasma display panel according to the present invention includes first and second substrates placed opposed to each other, a plurality of scan electrodes and common electrodes provided on the surface side of the first substrate facing the second substrate and extending in a first direction, and a plurality of data electrodes provided on the surface side of the second substrate facing the first substrate and extending in a second direction orthogonal to the first direction, a display cell is provided each at the crossing point of the scan electrode and common electrode and the data electrode, and driving voltage increased with time such as ramp voltage having a voltage gradient of at most 7.5 V/$\mu$sec is applied to the scan electrode in a priming period. In the plasma display panel, the scan electrode and the common electrode include a transparent electrode, and a bus electrode formed more on the side of a discharge gap on the transparent electrode than the center thereof, extending in the first direction and shielding light emitted in the display cell by the applied driving voltage.

Note that the transparent electrode is preferably shared between display cells arranged in the first direction so that the electrode area is maximized to increase the peak luminance. Meanwhile, the transparent electrode may separately be provided for each display cell and have a comb-tooth shape when viewed two-dimensionally. Note however that when the transparent electrode is formed in a comb-tooth shape, preferably a mesh barrier rib structure is provided on the second substrate or the thickness of the bus electrode is at least 5 $\mu$m. The transparent electrode may have an opening formed for each display cell. In this case, the opening is preferably formed in contact with the bus electrode when viewed two-dimensionally. Note however that the transparent electrode may be without an opening.

Another plasma display panel according to the present invention includes first and second substrates placed opposed to each other, a plurality of scan electrodes and common electrodes provided on the surface side of the first substrate facing the second substrate and extending in a first direction, and a plurality of data electrodes provided on the surface side of the second substrate facing the first substrate and extending in a second direction orthogonal to the first direction, a display cell is provided each at the crossing point of the scan electrode and common electrode and the data electrode, and driving voltage increased with time such as ramp voltage having a voltage gradient of at most 7.5 V/$\mu$sec is applied to the scan electrode in a priming period. In the plasma display panel, the scan electrode and common electrode include a transparent electrode and a bus electrode formed on the transparent electrode and extending in the first direction, the transparent electrode includes a base portion, and a projection jutting out from the base portion to another transparent electrode within the same display cell.

According to the present invention, the area of the projection when viewed two-dimensionally is preferably in the range from 10% to 50% of the value produced by W×H, where W represents the width of the cell, and H represents the distance between the top of the projection and the base portion.

The length of the side end of the projection forming the shortest discharge gap is preferably substantially equal to the length of the side end of the projection in contact with the base portion. In other words, the projection preferably has a rectangular shape.

Another plasma display panel according to the present invention includes first and second substrates placed opposed to each other, a plurality of scan electrodes and common electrodes provided on the surface side of the first substrate facing the second substrate and extending in a first direction, a plurality of data electrodes provided on the surface side of the second substrate facing the first substrate and extending in a second direction orthogonal to the first direction, a display cell is provided each at the crossing point of the scan electrode and common electrode and the data electrode, driving voltage increased with time such as ramp voltage having a voltage gradient of at most 7.5 V/μsec is applied to the scan electrode in a priming period. In the plasma display panel, the scan electrode and common electrode include a bus electrode formed on the transparent electrode and extending in the first direction and an island-shaped electrode formed more on the discharge gap side on the transparent electrode than the center thereof.

According to the present invention, the island-shaped electrode preferably has an area smaller than that of the bus electrode. Therefore, the island-shaped electrode may be thinner than the bus electrode, or does not have to be continuous in the first direction.

According to the present invention, the island-shaped electrode may be made of the same material as that of the bus electrode, and preferably has a thickness of at least 5 μm. The island-shaped electrode is preferably made of one selected from the group consisting of an indium tin oxide film, a NESA film, a Cr film and a Cu film and preferably faces the discharge gap. The island-shaped electrode may face the discharge gap.

The bus electrode preferably has a thickness of at least 5 μm. Note that the bus electrode may have a black first electrode formed on the transparent electrode, and a second electrode formed on the first electrode and containing Ag.

Another plasma display panel according to the present invention includes first and second substrates placed opposed to each other, a plurality of scan electrodes and common electrodes provided on the surface side of the first substrate facing the second substrate and extending in a first direction, and a plurality of data electrodes provided on the surface side of the second substrate facing the first substrate and extending in a second direction orthogonal to the first direction, a display cell is provided each at the crossing point of the scan electrode and common electrode and the data electrode, driving voltage increased with time such as ramp voltage having a voltage gradient of at most 7.5 V/μsec is applied to the scan electrode in a priming period. In the plasma display panel, the scan electrode and common electrode include a transparent electrode and a bus electrode formed on the transparent electrode and extending in the first direction. The transparent electrode has an opening having its end on the non-discharge gap side located in a position apart from its end on the discharge gap side by 1 to 1.5 times as large as the discharge gap.

Another plasma display panel according to the present invention includes first and second substrates placed opposed to each other, a plurality of scan electrodes and common electrodes provided on the surface side of the first substrate facing the second substrate and extending in a first direction, and a plurality of data electrodes provided on the surface side of the second substrate facing the first substrate and extending in a second direction orthogonal to the first direction, a display cell is provided each at the crossing point of the scan electrode and common electrode and the data electrode, and driving voltage increased with time such as ramp voltage having a voltage gradient of at most 7.5 V/μsec is applied to the scan electrode in a priming period. In the plasma display panel, the scan electrode and common electrode include a transparent electrode, a first bus electrode formed on the transparent electrode more on the non-discharge gap side than the center thereof and a second bus electrode formed on the transparent electrode more on the discharge gap side than the center thereof, extending in the first direction and shielding light generated in the display cell by the applied driving voltage. The second bus electrode is thinner than the first bus electrode.

The second bus electrode may be disconnected in the first direction.

In a sustaining period, sustaining pulses in phase may be applied to one of the scan electrode and common electrode between adjacent display cells in the second direction, and interlace display may be provided. The relative positional relation between the scan electrode and the common electrode may be reversed between adjacent cells in the second direction.

There is preferably a mesh barrier rib structure formed on the second substrate for separating the display cells. In the scan electrode and the sustain electrode, a region at least 10 μm apart from the side end of the scan electrode and sustain electrode facing the discharge gap is preferably made of one selected from the group consisting of an indium tin oxide film, a NESA film, a Cr film, and a Cu film.

According to the present invention, the priming discharge is localized in the vicinity of the discharge gap, and there is no light emission in the periphery of the display cell. Meanwhile, light emission by sustaining discharge is generated in the entire display cell. Therefore, the black luminance is lowered, and the luminance in the sustaining discharge improves, which improves the contrast.

The plasma display according to the present invention includes any one of plasma display panels described above.

By a method of manufacturing a plasma display panel according to the present invention, a plasma display panel having a island-shaped electrode made of the same material as the bus electrode is produced. The method includes the steps of forming the transparent electrode on the second substrate, forming a material film for the bus electrode and an island-shaped electrode on the transparent electrode, and patterning the material film, thereby forming the bus electrode and the island-shaped electrode at a time.

BRIEF DESCRIPTION OF THE DRAWINGS

FIG. 4A shows the relation in a sustaining period, while FIG. 4B shows the relation in a priming period;

FIG. 7A is a plan view showing a discharge region in the first embodiment, FIG. 7B is a sectional view showing the electric line of force thereof, FIG. 7C is a plan view showing a discharge region in the conventional plasma display panel, FIG. 7D is a sectional view showing the electric line of force thereof;

FIG. 12A is a plan view showing a discharge region, FIG. 12B is a plan view showing the electric line of force;

FIG. 20A is a plan view showing a discharge region, FIG. 20B is a plan view showing the electric line of force, and FIG. 20C is the sectional view showing the electric line of force;

FIG. 22A is a plan view showing the discharge region, FIG. 22B is a plan view showing the electric line of force, and FIG. 22C is a sectional view showing the electric line of force;

DETAILED DESCRIPTION OF THE PREFERRED EMBODIMENT

Figure 1:
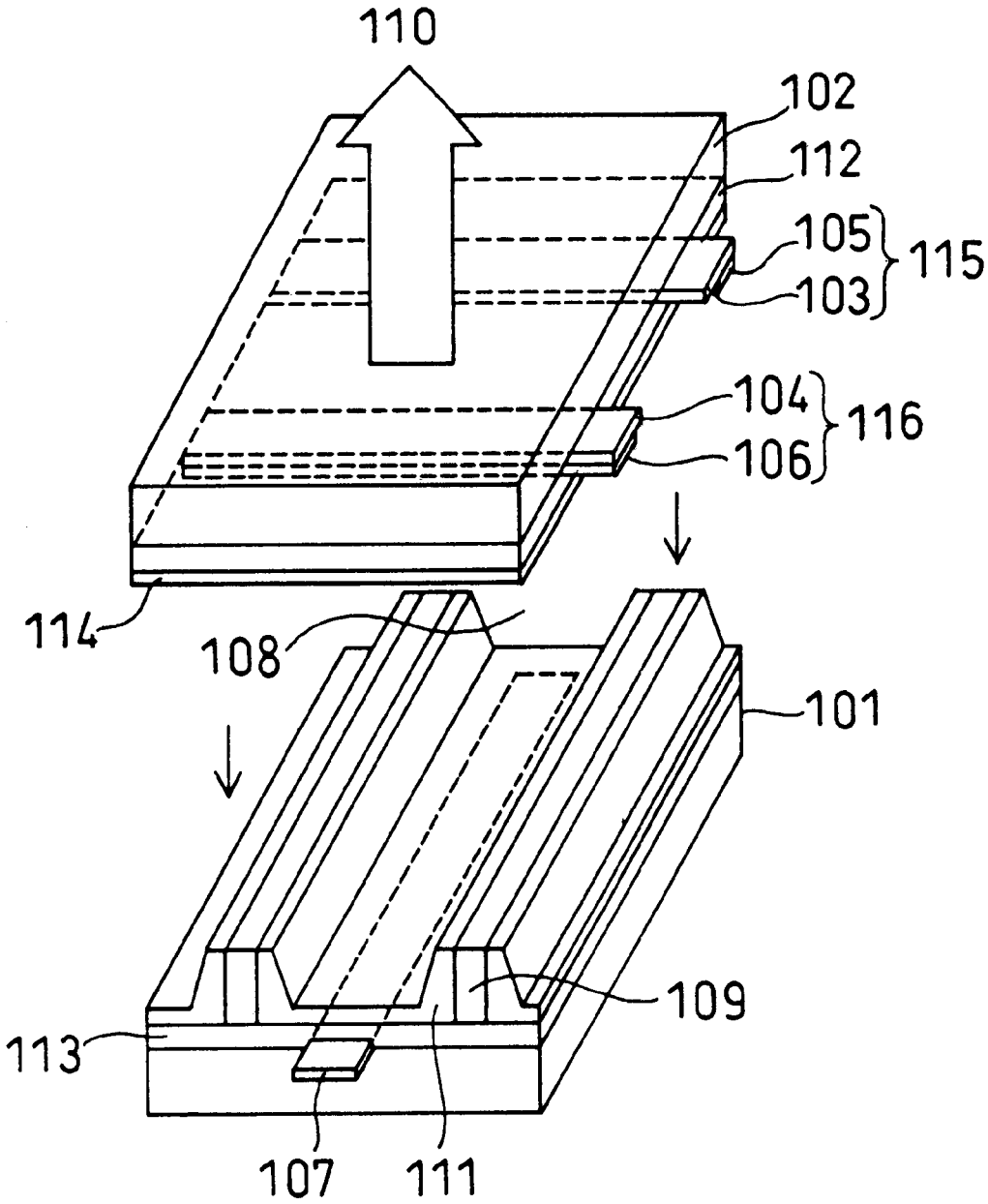
FIG. 1 (PRIOR ART)
FIG. 1 is a perspective view of a single display cell in an AC type plasma display panel.
Figure 2A:
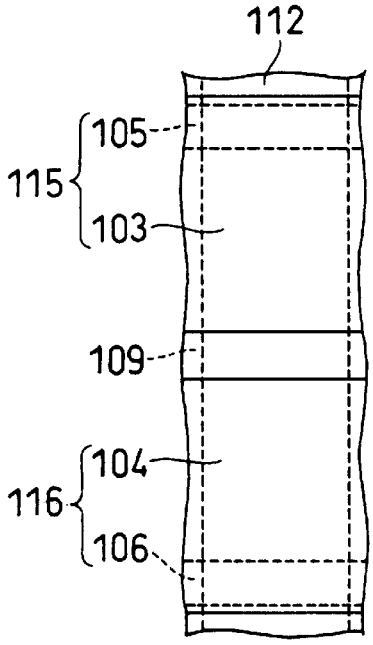
FIG. 2A (PRIOR ART)
FIGS. 2A and 2B are a plan view and a sectional view respectively, showing in detail the shapes of a scan electrode and a common electrode in a conventional plasma display panel.
Figure 2B:
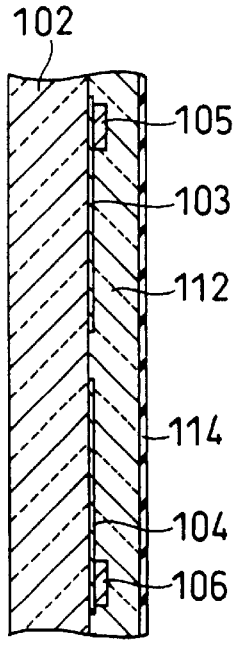
FIG. 2B (PRIOR ART)
Figure 5:
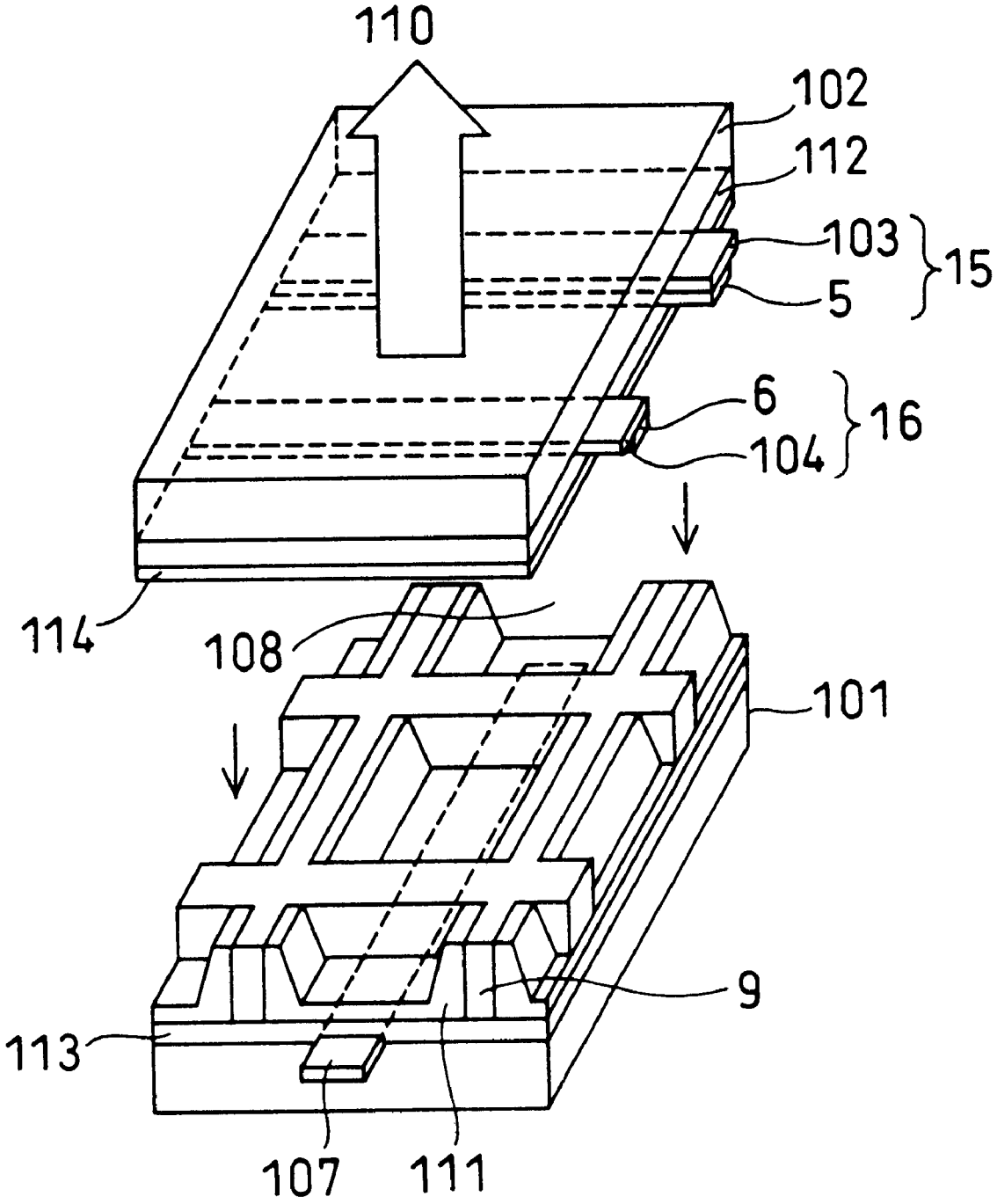
FIG. 5 is a perspective view showing the structure of one display cell in a plasma display panel according to a first embodiment of the invention.
Figure 6A:
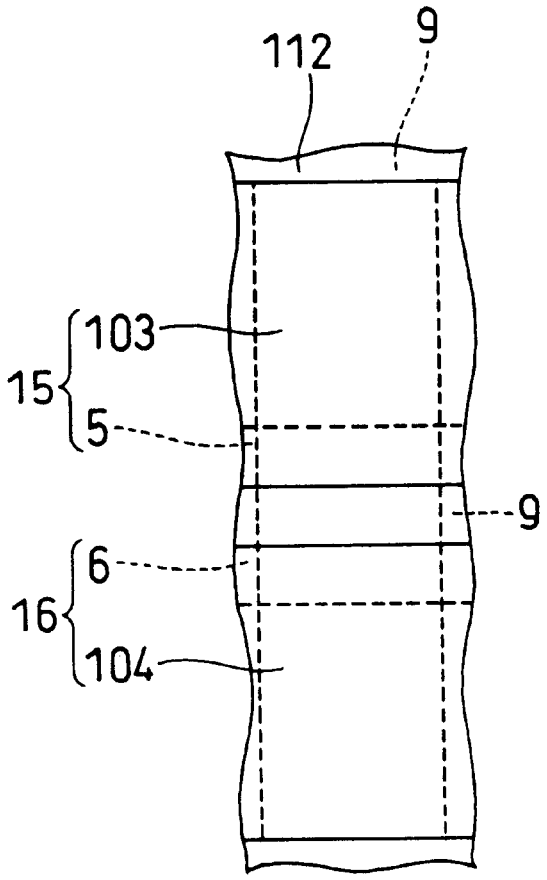
FIGS. 6A and 6B are a plan view and a sectional view respectively, showing in detail the shapes of a scan electrode and a common electrode in the plasma display panel according to the first embodiment.
Figure 6B:
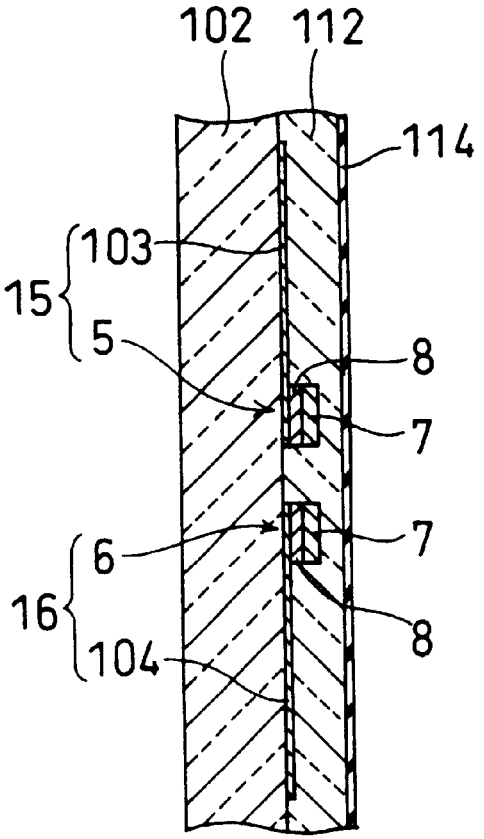

Plasma display panels according to embodiments of the present invention will now be described in detail in conjunction with the accompanying drawings. In the following embodiments, similarly to the conventional plasma display panels, a priming pulse in a blunt waveform in which the voltage increases with time during a priming period is applied to the scan electrode at the time of driving. FIG. 5 is a perspective view of one display cell in the plasma display panel according to a first embodiment of the invention. FIGS. 6A and 6B are a plan view and a sectional view showing in detail the shapes of a scan electrode and a common electrode in the plasma display panel according to the first embodiment. Note that in the first embodiment shown in FIGS. 5, 6A and 6B, the same elements as those of the conventional plasma display panel shown in FIGS. 1 and 2 are denoted by the same reference characters and are not detailed.

According to the first embodiment, there is a mesh barrier rib structure 9 separating display cells in the horizontal and vertical directions instead of the stripe barrier rib structure 109. The display cells are therefore completely isolated from adjacent display cells. Bus electrodes 5 and 6 are provided to be superposed on a transparent electrode 103 and a common electrode 104, respectively instead of the bus electrodes 105 and 106. The bus electrodes 5 and 6 are each a thin film electrode made for example of a layered body including a white Ag thin film and a black $RuO_2$ thin film 8 and having a thickness of about 7 $\mu$m. The transparent thin film electrode 103 and the bus electrode 5 form a scan electrode 15, while the transparent electrode 104 and the bus electrode 6 form a common electrode 16. Within one display cell, the bus electrodes 5 and 6 are placed in the closest positions to the surface discharge gap between the transparent electrodes 103 and 104, respectively.

Figure 7A:
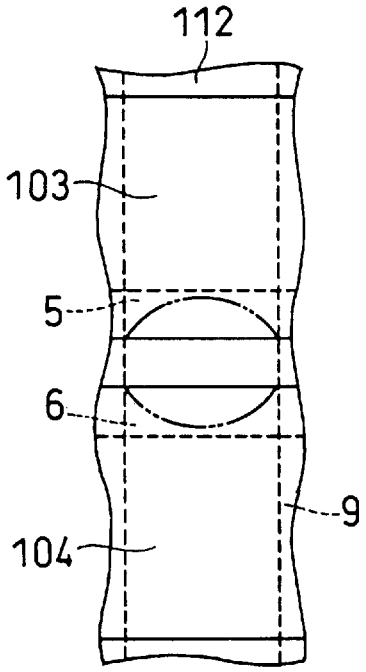
FIGS. 7A to 7D are views for use in illustration of priming discharge.
Figure 7B:
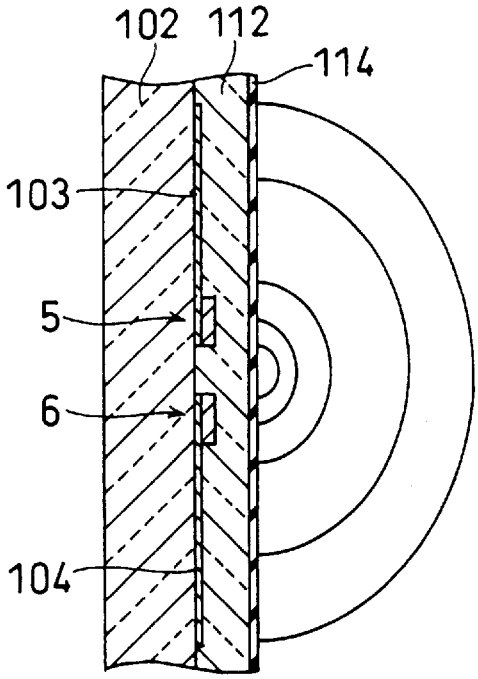
Figure 7C:
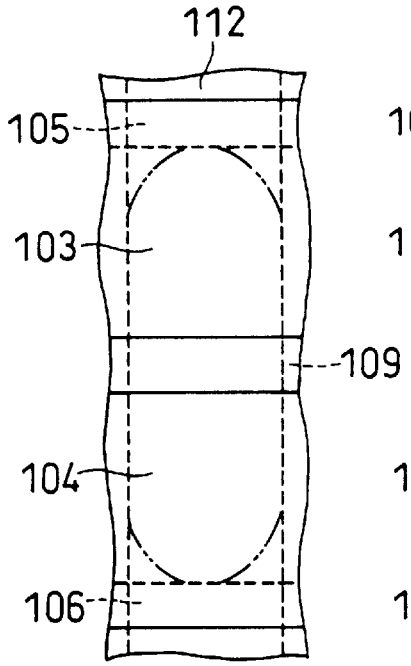
Figure 7D:
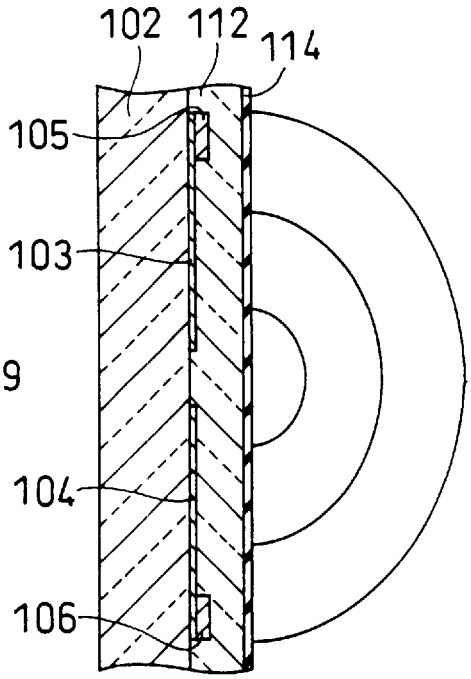
Figure 8:
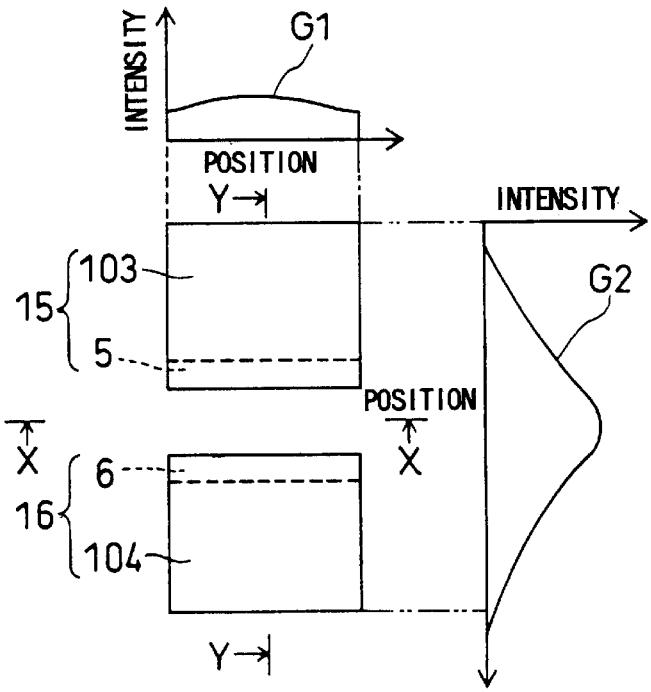
FIG. 8 is a plan view showing a discharge region in the first embodiment as in FIG. 7A, attached with the graphs G1 and G2 representing the distribution of luminescence intensity in priming discharge in sections taken along lines X—X and Y—Y, respectively in FIG. 8.
Figure 9:
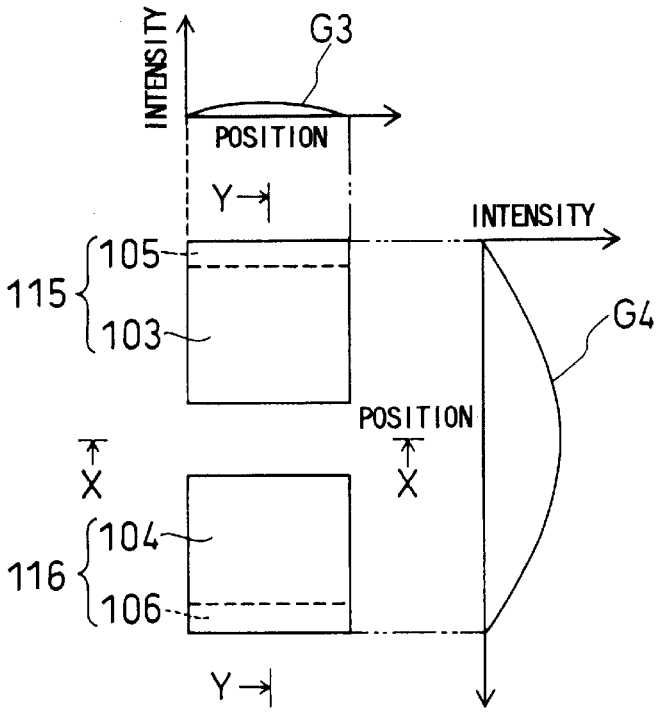
FIG. 9 is a plan view showing a discharge region in a conventional display panel as in FIG. 7C, attached with graphs G3 and G4 representing the distribution of luminescence intensity in priming discharge in sections taken along lines X—X and Y—Y, respectively in FIG. 9.

In the first embodiment as described above, priming discharge is generated only in the vicinity of the discharge gap as opposed to the conventional plasma display in which the priming discharge is spread within the display cell. FIGS. 7A to 7D are views for use in illustration of priming discharge. FIG. 7A is a plan view showing a discharge region in the first embodiment. FIG. 7B is a sectional view showing the electric line of force thereof. FIG. 7C is a plan view showing a discharge region in the conventional plasma display panel. FIG. 7D is a sectional view showing the electric line of force thereof. FIG. 8 is a plan view showing a discharge region in the first embodiment as in FIG. 7A. The graphs G1 and G2 show the luminescence intensity distribution in priming discharge in sections taken along lines X—X and Y—Y, respectively in FIG. 8. Similarly, FIG. 9 is a plan view showing a discharge region in the conventional plasma display panel as in FIG. 7C. The graphs G3 and G4 show the luminescence intensity distribution in the priming discharge in sections taken along lines X—X and Y—Y in FIG. 9, respectively. Note that the part surrounded by the chain double-dotted line in FIGS. 7A and 7C is the discharge region.

As shown in FIG. 7B, the electric line of force generated by the priming discharge according to the first embodiment is dense in the vicinity of the bus electrodes 5 and 6 and sparse in the periphery of a display cell. As a result, as shown in FIGS. 7A and 8, the light emission by the priming discharge concentrates in the center of the display cell, in other words in the vicinity of the discharge gap in the vertical direction of the panel. However, a large part of light emitted by the part is shielded by the bus electrodes 5 and 6, and is scarcely let out.

Meanwhile, as shown in FIG. 7D, in the conventional plasma display panel, the electric line of force generated by the priming discharge spreads equally over the display cell. Therefore, as shown in FIGS. 7C and 8B, light is emitted by the priming discharge at the entire display cell. In this case, unlike the first embodiment, the light is scarcely shielded by the bus electrodes 105 and 106, and therefore most of the emitted light is let out. Therefore, according to the first embodiment the black luminance can significantly be reduced as compared to the conventional panel.

Figure 10B:
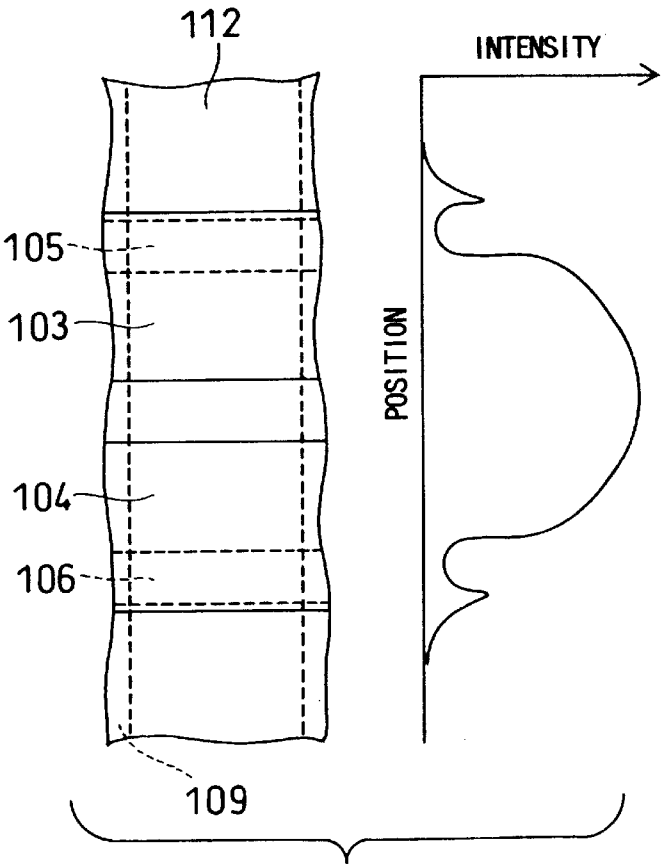
FIG. 10B is a plan view showing the intensity when a stripe barrier rib structure is provided, attached with a graph representing the intensity in the vertical direction of the panel in this case.
Figure 10A:
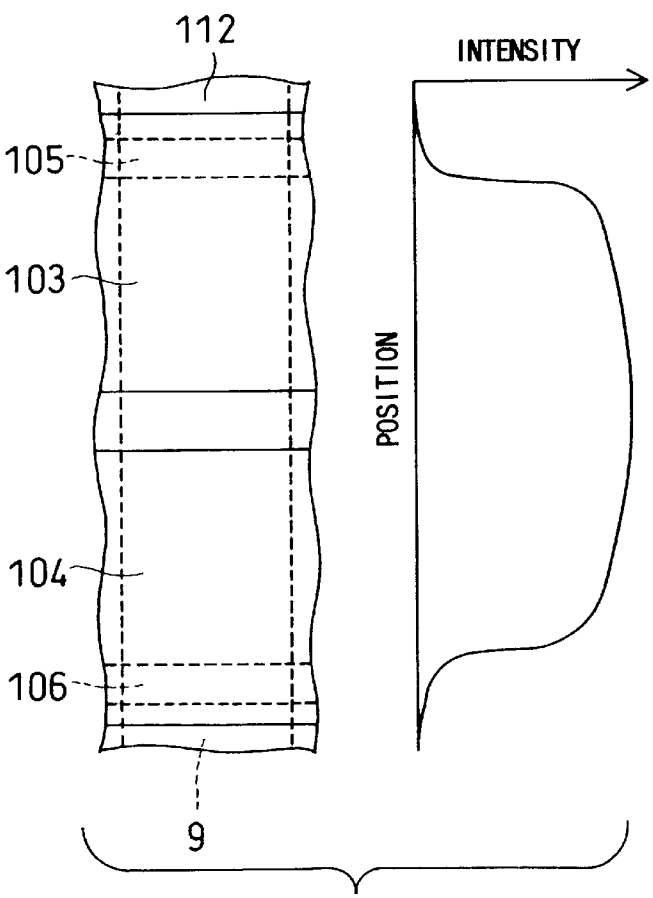
FIG. 10A is a plan view showing the intensity distribution of sustaining discharge when a mesh barrier rib structure is provided, attached with a graph representing the intensity in the vertical direction of the panel in this case.

According to the first embodiment, high peak luminance can be obtained. FIGS. 10A and 10B show the intensity distribution in sustaining discharge. FIG. 10A is a plan view when a mesh barrier rib structure is provided, attached with a graph showing the intensity in the vertical direction of the panel in this case. FIG. 10B is a plan view when a stripe barrier rib structure is provided, attached with a graph showing the intensity in the vertical direction of the panel in this case.

When the stripe barrier rib structure as in FIG. 10B is used, no barrier rib shields in the vertical direction of the panel, and therefore there must be a large non-discharge gap between adjacent cells in the vertical direction. The bus electrodes on the non-discharge gap side are therefore positioned closer to the discharge gap. Meanwhile, when the mesh barrier rib structure as in FIG. 10A is used, the barrier ribs shield in the vertical direction of the panel, and therefore sustaining discharge does not expand to adjacent cells in the vertical direction. Therefore, only a small non-discharge gap is necessary and sufficient between adjacent cells in the vertical direction. The position of the bus electrodes on the non-discharge gap side is further from the discharge gap. Therefore, the following difference is present in the intensity distribution in sustaining discharge between the cases of using the stripe barrier rib structure and the mesh barrier rib structure. Note that the surface discharge electrode used here is an electrode for the conventional display panel.

As shown in FIG. 10A, when a mesh barrier rib structure is provided, the intensity of the sustaining discharge is substantially equal over the entire display cell. The ratio of the light shielded by the bus electrodes to the entire emitted light is low, and is substantially constant regardless of the position of the shielding bus electrodes in the display cell. In contrast, when a stripe barrier rib structure is provided, as shown in FIG. 10B, the intensity of the sustaining discharge is maximized in the vicinity of the discharge gap, and lowered toward the vicinity of the upper and lower edges of the display cell. Therefore, if the bus electrodes are provided in the vicinity of the discharge gap, the ratio of the light shielded by the bus electrodes to the entire emitted light is extremely large. In the first embodiment, as shown in FIG. 5, since the mesh barrier rib structure 9 is provided, the ratio of the light shielded by the bus electrodes 5 and 6 relative to the sustaining light emission is low, so that high peak luminance is provided. As described above, according to the first embodiment, the black luminance is lowered and the peak luminance increases. This significantly improves the contrast since the contrast is represented by the ratio of the peak luminance during the sustaining period relative to the black luminance.

The electric field concentrates in the vicinity of the discharge gap where discharge is easily generated, and therefore the threshold voltage for discharge between the scan electrode 15 and the common electrode 16 is lower than the conventional case. In addition, the dielectric layer 112 is thinner in the position of the bus electrodes 5 and 6 than in the other parts. Therefore, the electric field tends to be easily intensified at the part, and wall charge tends to be easily formed to cancel the electric field. As a result, the sustaining voltage can be lowered. This can contribute to reduction in the power consumption.

Figure 11:
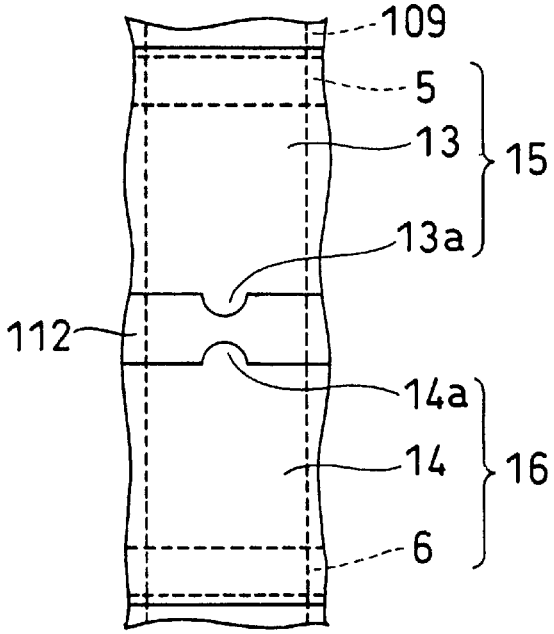
FIG. 11 is a plan view showing the shapes of a scan electrode and a common electrode in a plasma display panel according to a second embodiment of the invention.

A second embodiment of the present invention will now be described. FIG. 11 is a plan view showing the shapes of a scan electrode and a common electrode in a plasma display panel according to the second embodiment. Note that in the second embodiment shown in FIG. 11, the same elements as those of the first embodiment are denoted by the same reference characters and are not be detailed.

According to the second embodiment, transparent electrodes 13 and 14 are provided instead of the transparent electrodes 103 and 104, respectively. The transparent electrodes 13 and 14 have projections 13*a* and 14*a*, respectively in a semi-circular shape in the centers of parts opposed to one another in one cell. The distance between the transparent electrodes 13 and 14 is smaller between the parts than in the other parts.

Similarly to the first embodiment, bus electrodes 5 and 6 are provided. The bus electrodes 5 and 6 are however provided in the vicinity of the upper and lower edges of the display cell similarly to the conventional plasma display panel. According to the embodiment, the transparent electrode 13 and the bus electrode 5 form a scan electrode 15, while the transparent electrode 14 and the bus electrode 6 form a common electrode 16.

Figure 12A:
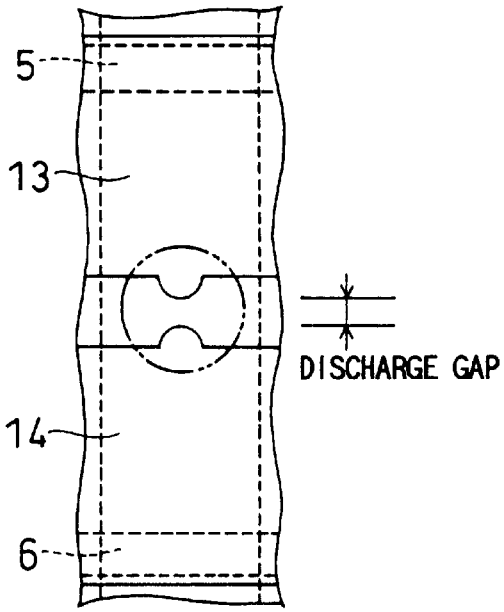
FIGS. 12A and 12B are views for use in illustration of priming discharge according to the second embodiment.
Figure 12B:
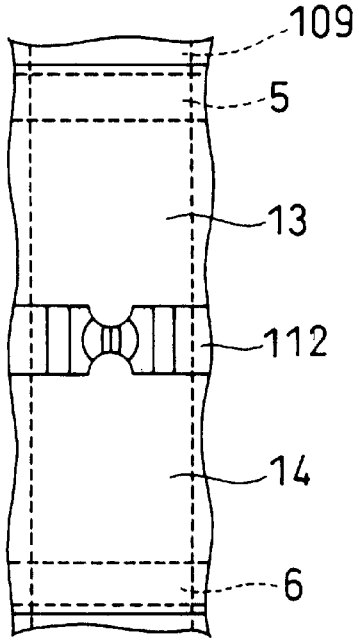
Figure 13:
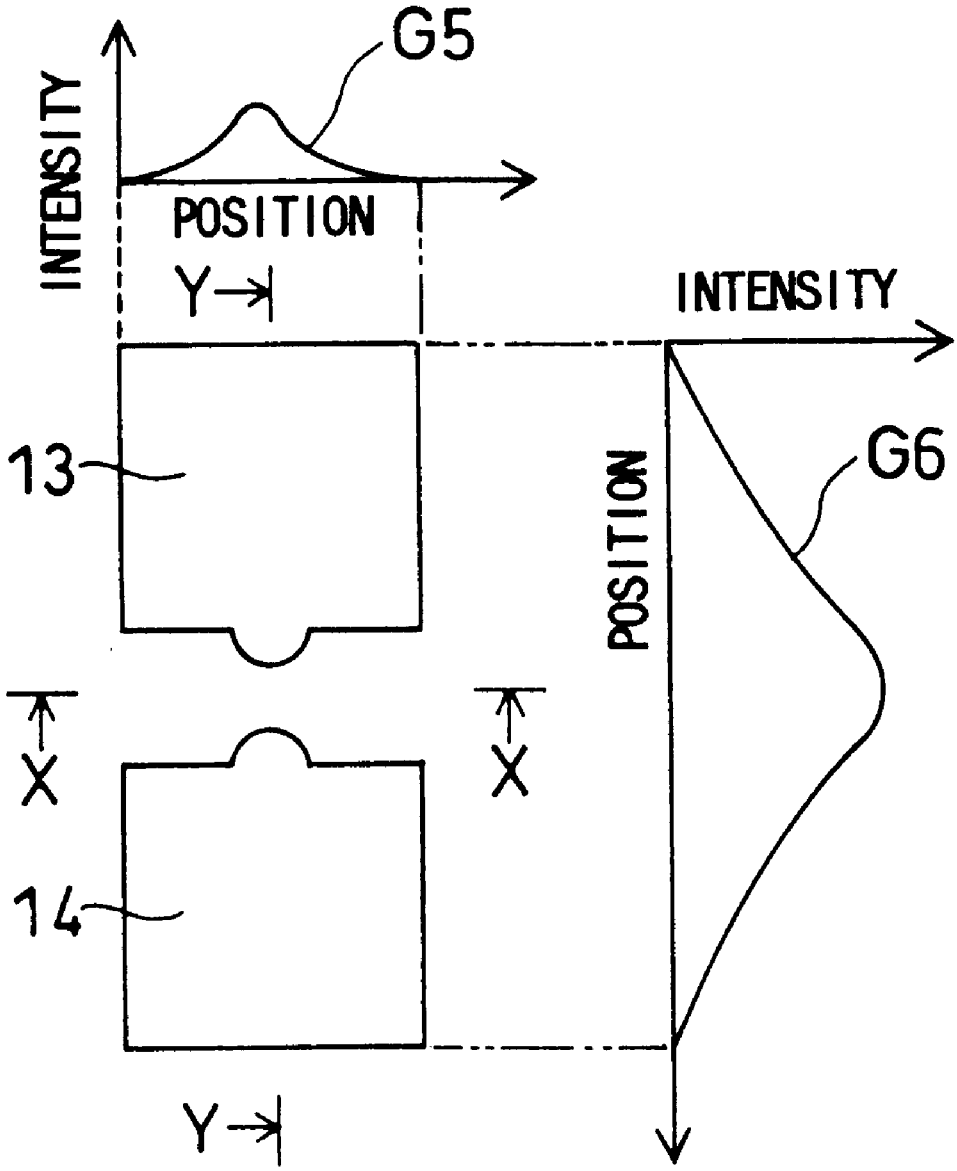
FIG. 13 is a plan view showing a discharge region in the second embodiment as in FIG. 12A, attached with the graphs G5 and G6 representing the distribution of luminescence intensity in priming discharge in sections taken along lines X—X and Y—Y in FIG. 13, respectively.

According to the second embodiment described above, priming discharge is generated only in the vicinity of the discharge gap. FIGS. 12A and 12B are views for use in illustration of priming discharge in the second embodiment. FIG. 12A is a plan view showing a discharge region, while FIG. 12B is a plan view showing the electric line of force. FIG. 13 is a plan view showing the discharge region in the second embodiment as in FIG. 12A, attached with the graphs G5 and G6 showing the luminescence intensity distribution in the priming discharge in sections taken along lines X—X and Y—Y in FIG. 13, respectively. Note that the part surrounded by the chain double-dotted line in FIG. 12A is the discharge region.

As shown in FIG. 12B, the electric line of force generated by the priming discharge according to the second embodiment is dense in the vicinity of the projections 13*a* and 14*a* and sparse in the periphery of the display cell. As a result, as shown in FIG. 12A, light emission by the priming discharge concentrates in the center of the display cell and no light is emitted in the periphery of the display cell. As shown in FIG. 13, the concentration of light emission by the priming discharge is caused in any of the horizontal and vertical directions. Therefore, the light emission by the priming discharge is extremely weak, so that the black luminance is lowered and the contrast is improved.

Since wall charge is formed in the vicinity of the discharge gap during a writing period, sustaining discharge tends to be easily generated in response to the first discharge pulse in a sustaining discharge period. The transition from opposed discharge to surface discharge can therefore stably be made during the writing period. Therefore, the voltage of a data pulse applied to a data electrode 107 during a writing period may be lowered, which can contribute to reduction in the power consumption.

Furthermore, according to the embodiment, there is no bus electrode to shield light emitted in the vicinity of the discharge gap, and therefore peak luminance higher than that of the first embodiment may be provided.

Note that the shape of the projections provided at the transparent electrodes are not limited to the semi-circular shape. FIG. 14A is a plan view of a projection provided at a transparent electrode, and FIGS. 14B to 14F are plan views showing other projections.

As shown in FIG. 14A, the projection 21*a* may project from the strip-shaped base 21 in a triangular shape and then form a bell shape on the top of it. Note however that the percentage of the projection 21*a* to occupy in the region surrounded by the chain double-dotted line in FIG. 14A is preferably from 10% to 50%. More specifically, the region is surrounded by the boundary 21*b* between the base 21 having a fixed width and the projection 21*a*, a line 21*c* (length: W) parallel to the boundary 21*b* and in contact with the top of the projection 21*a* and the side edges 21*d* (length: H) of the display cell. This percentage will hereinafter be referred to as "electrode occupying percentage." The height of the projection 21*a*, i.e., the length of the side edge 21*d* of the display cell is preferably at most 1.5 times as large as the discharge gap, more preferably equal to or smaller than the discharge gap. Note that the discharge gap in FIG. 8 is the shortest distance between the surface discharge electrodes as shown in FIG. 12.

Figures 14B, 14C, 14D, 14E, 14F:
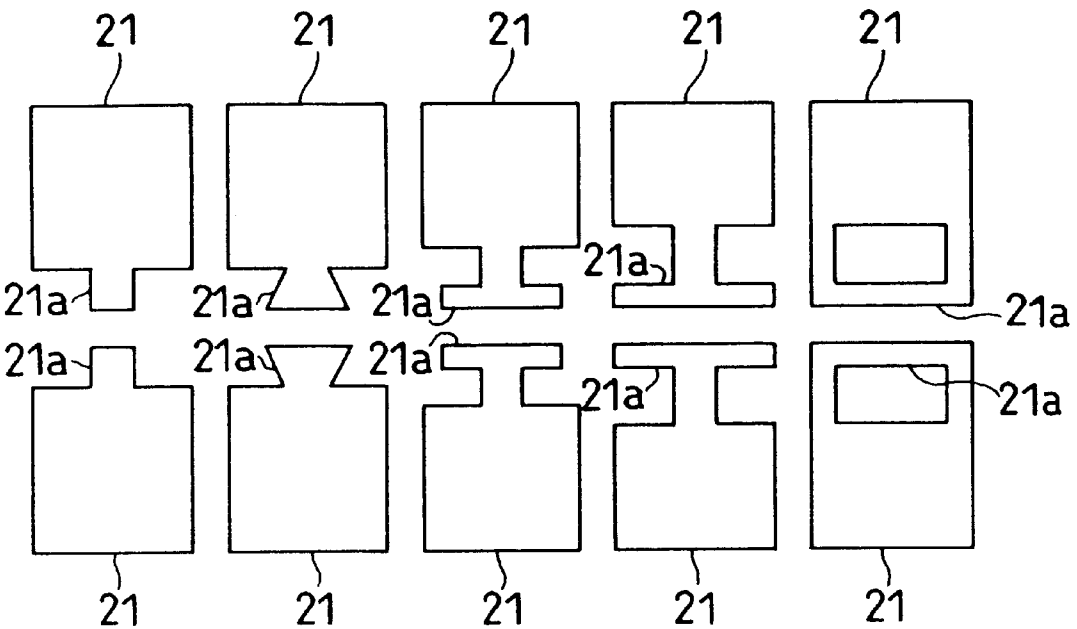
FIGS. 14B to 14F are plan views of other projections.
Figure 14A:
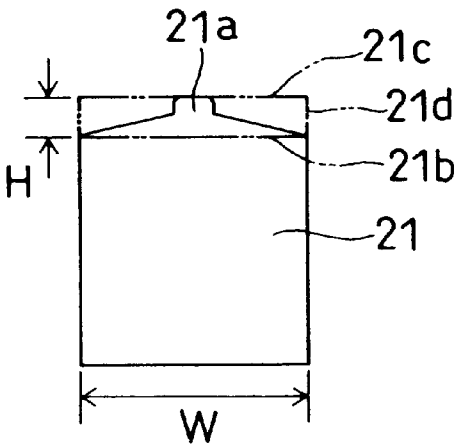
FIG. 14A is a plan view of a projection provided at a transparent electrode.

The projection may have a shape as shown in FIGS. 14B to 14F in addition to the shape as shown in FIG. 14A. Among these shapes, the shape shown in FIG. 14B reduces the black luminance most, while the shape causes the threshold voltage for discharge to be highest. In contrast, the shape as shown in FIG. 14F reduces the black luminance slightly less than the other shapes, while the threshold voltage for discharge is lowest. For the present, cell designs with lower threshold voltage for discharge are strongly desired, and therefore the shape as shown in FIG. 14F may be most practically applied, while higher threshold voltage for discharge may be tolerated in the future, and then the shape as shown in FIG. 14B should be expected to be most practical in the condition.

Figure 15:
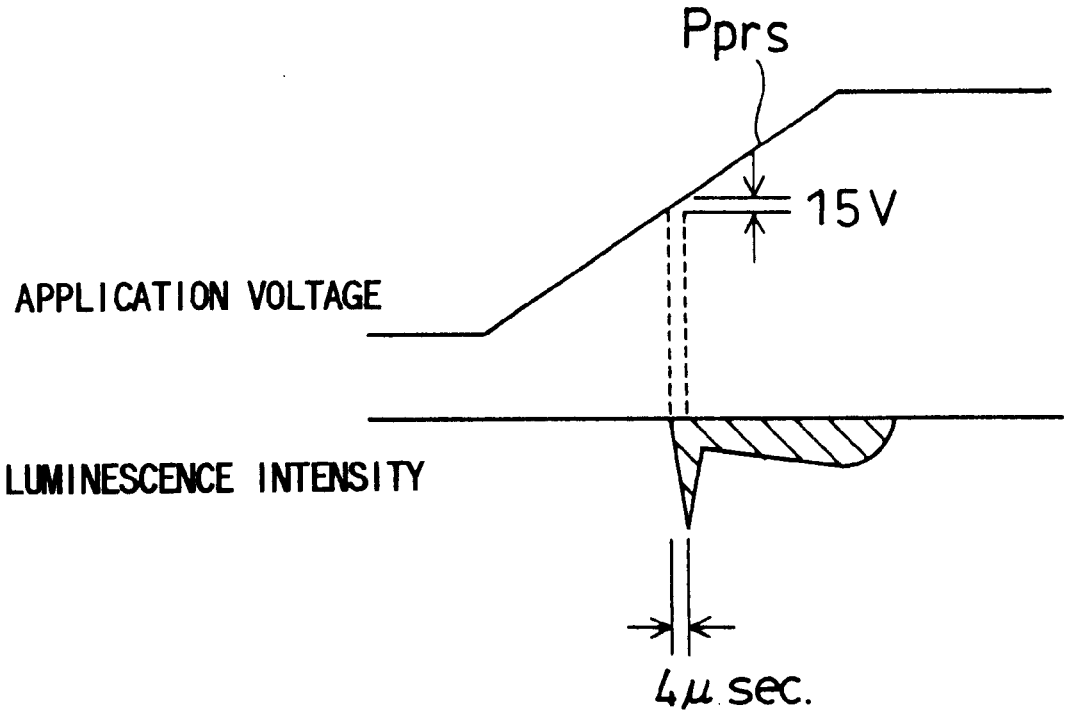
FIG. 15 is a timing chart for use in illustration of the relation between the application voltage and the luminescence intensity.

FIG. 15 is a timing chart for use in illustration of the application voltage and the luminescence intensity. In the case of blunt priming, relatively strong discharge in the beginning of light emission reaches its peak after about four microseconds. When the gradient of the priming pulse Ppr-s is 4 V/$\mu$sec, the voltage at the scan electrode increases by about 15 V during the four microsecond period. Thus, the voltage at the scan electrode increases during the period between the start of the priming discharge and the peak of the luminescence intensity. Therefore, the emitted light must be prevented from diffusing within the display cell because of the voltage increase. When the electrode occupying percentage is less than 10% however, the emitted light cannot be prevented from diffusing, the black luminance increases, and sufficient contrast cannot easily be obtained. Meanwhile, when the electrode occupying percentage is more than 50%, the priming discharge is unlikely to be localized to the vicinity of the discharge gap.

Figure 16A:
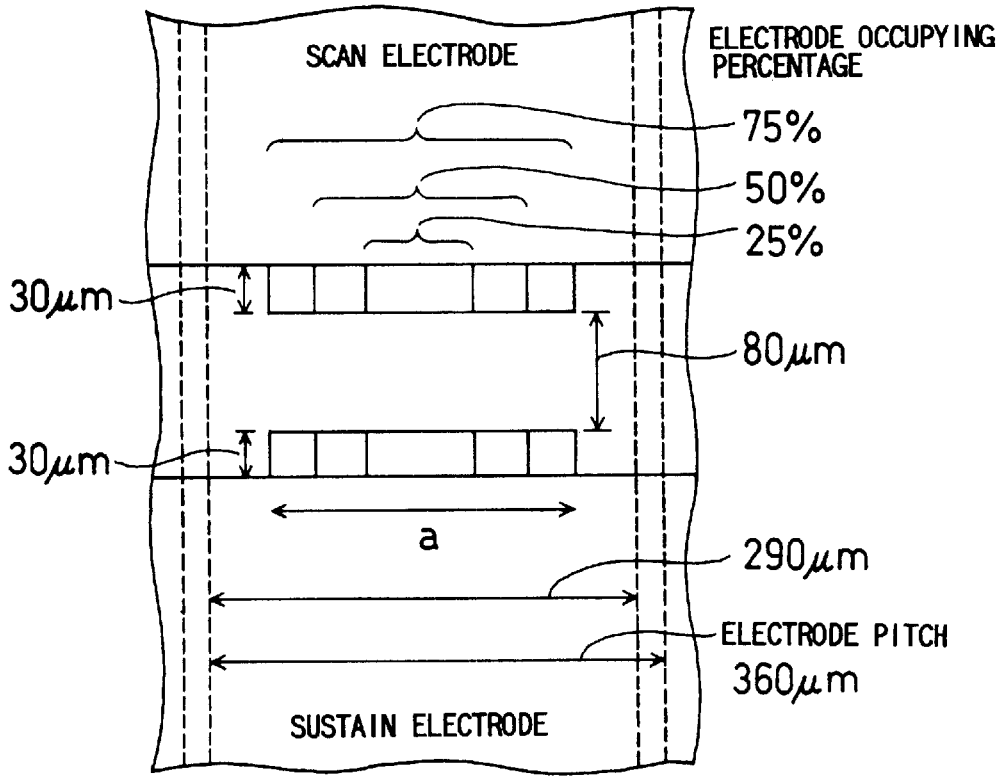
FIG. 16A is a view for use in illustration of a method of evaluating the luminescence intensity in priming discharge depending on the electrode occupying percentage.

The inventor evaluated the luminescence intensity of the priming discharge depending on the electrode occupying percentage using the surface discharge electrodes as shown in FIG. 16A. The electrode pitch of the scan electrode and sustain electrode is 360 $\mu$m, the width of the stripe barrier rib is 70 $\mu$m, and therefore the electrode width between the barrier ribs is 290 $\mu$m. Projections are jut out from the scan electrode and the sustain electrode toward the discharge gap in the center of the width of both electrodes. The length of the projected part is about 30 $\mu$m for both electrodes. The discharge gap is 80 $\mu$m. The width a of the projection in the horizontal direction is changed to change the electrode occupying percentage. The position of the projection in the horizontal direction is always in the middle between both barrier ribs.

Figure 16B:
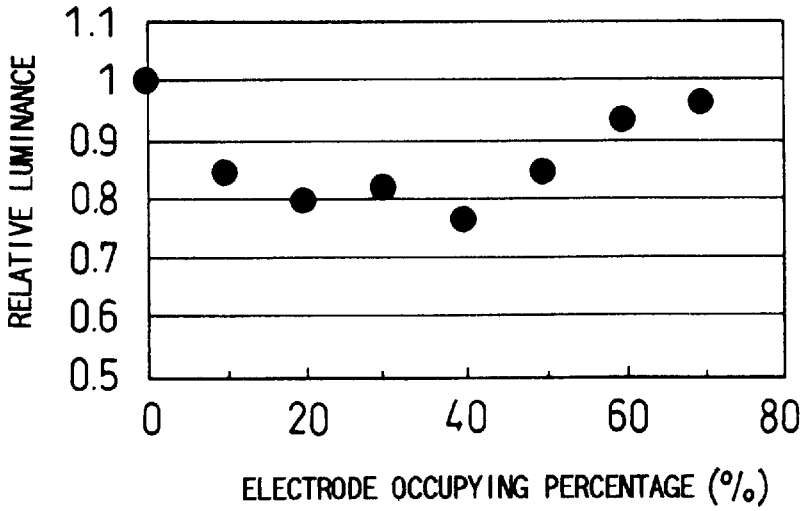
FIG. 16B is a graph representing the relation between the electrode occupying percentage and the relative luminance.
Figure 17:
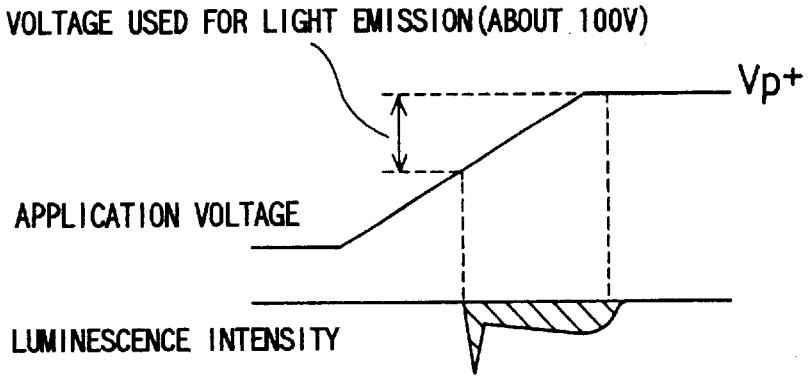
FIG. 17 is a chart for use in illustration of how application voltage is adjusted to cause priming discharge at surface electrodes in FIG. 16A.

FIG. 17 is a chart for use in illustration of how application voltage is adjusted to generate priming discharge at the surface electrodes in FIG. 16A. The final target voltage Vp+ for a suitable priming pulse is initially set, and a blunt priming waveform as shown in FIG. 17 is applied to the surface discharge electrodes to generate priming discharge. At the time, when there is large difference between the threshold voltage for discharge and the final target voltage Vp+ for the priming pulse, the light emission period is much prolonged, which increases the black luminance. For an experiment, if the difference between the threshold voltage for discharge and the final target voltage Vp+ is set to about 100 V, the entire panel can equally be initialized, and the black luminance can be restrained to a low level. The threshold voltage for discharge was measured in a preliminary experiment, and then in a main experiment, the final target voltage Vp+ for the priming pulse was set to be equal to the threshold voltage for discharge plus 100 V. The value of luminescence luminance in the priming discharge relative to the electrode occupying percentage according to the above method is given in the table in FIG. 16B.

The principle of how weak discharge as shown in FIG. 17 is generated can be explained as follows. When the application voltage reaches the threshold voltage for discharge, discharge is generated between the projections of the electrodes. Then, because of the discharge, wall charge is formed at the projection, which functions to weaken the application voltage. The application voltage however still increases during this period, and therefore the discharge spreads from the projections of the electrodes to a region apart from the discharge gap, and the weak discharge as shown in FIG. 17 is generated.

It was found from experiments that a shape having a projection having a longer part facing the shortest discharge gap as shown in FIG. 16A allows more stabilized priming discharge to be achieved than the shape as shown in FIG. 14A. In the case of the projection in a shape as shown in FIGS. 12A/12B having only a short part facing the shortest discharge gap, the effective electrode occupying percentage would be determined based on the length of the part facing the shortest discharge gap, or a length produced by adding a certain margin to the length.

As shown in FIG. 16B, when the electrode occupying percentage is from 10% to 50% as described above, the black luminance is significantly lower than that when the electrode occupying percentage is 0%, 60%, or 80%. Note that the electrode occupying percentage is 0% for the conventional case without projections. At an electrode occupying percentage above 40%, the black luminance increases. This is simply because the electrodes have an increased area. In contrast, at an electrode occupying percentage less than 20%, the black luminance abruptly increases, because the projections scarcely contribute to reduction in the voltage, and substantially only the base portion contributes to light emission.

Meanwhile, when the projection 21*a* has a height more than 1.5 times as large as the discharge gap, the effect of reducing the black luminance does not increase. In addition, the discharge in a sustaining period itself is weakened, which adversely affects the improvement in the contrast to which the present invention is directed. Consequently, if the discharge gap is in the range from 70 $\mu$m to 80 $\mu$m, the height of the projection 21*a* is 105 $\mu$m or less, preferably 80 $\mu$m or less.

Figure 18:
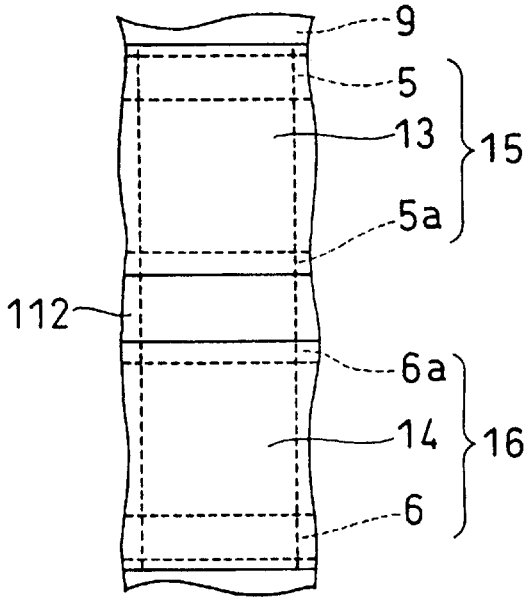
FIG. 18 is a plan view showing the shapes of a scan electrode and a common electrode in a plasma display panel according to a third embodiment of the invention.

A third embodiment of the present invention will now be described. FIG. 18 is a plan view showing the shapes of a scan electrode and a common electrode in a plasma display panel according to the third embodiment. Note that the elements the same as those of the first or second embodiment are denoted by the same reference characters and are not detailed.

According to the third embodiment, similarly to the first embodiment, a mesh barrier rib structure 9 is provided, while similarly to the second embodiment, bus electrodes 5 and 6 are provided in the vicinity of the upper and lower edges of a display cell. For each cell, bus electrodes 5*a* and 6*b* are provided at the positions closest to the surface discharge gap between transparent electrodes 13 and 14. The bus electrodes 5*a* and 6*a* are made of the same material as that of the bus electrodes 5 and 6 for example, and have a width smaller than that of the bus electrodes 5 and 6. According to the embodiment, the transparent electrode 13 and bus electrodes 5 and 5*a* form a scan electrode 15, while the transparent electrode 14 and the bus electrodes 6 and 6*a* form a common electrode 16.

According to the third embodiment as described above, the bus electrodes 5 and 6 on the non-discharge gap side are provided in positions which hardly contribute to light emission, and therefore light shielded by them is extremely scarce. The bus electrodes 5*a* and 6*a* on the discharge gap side are narrower than the bus electrodes 5 and 6, and therefore the light shielded by them is less than that in the first embodiment. Consequently, higher peak luminance than that in the first embodiment is provided. Furthermore, the resistance across the region to the drivers can sufficiently be reduced because of the bus electrodes 5 and 6, so that there is not any problem in driving when the bus electrodes 5*a* and 6*a* are disconnected. The bus electrodes 5*a* and 6*a* can be as narrow as possible until they could be disconnected or even narrower. The priming discharge therefore can be more localized around the discharge gap. Thus, the contrast is more improved.

Figure 19:
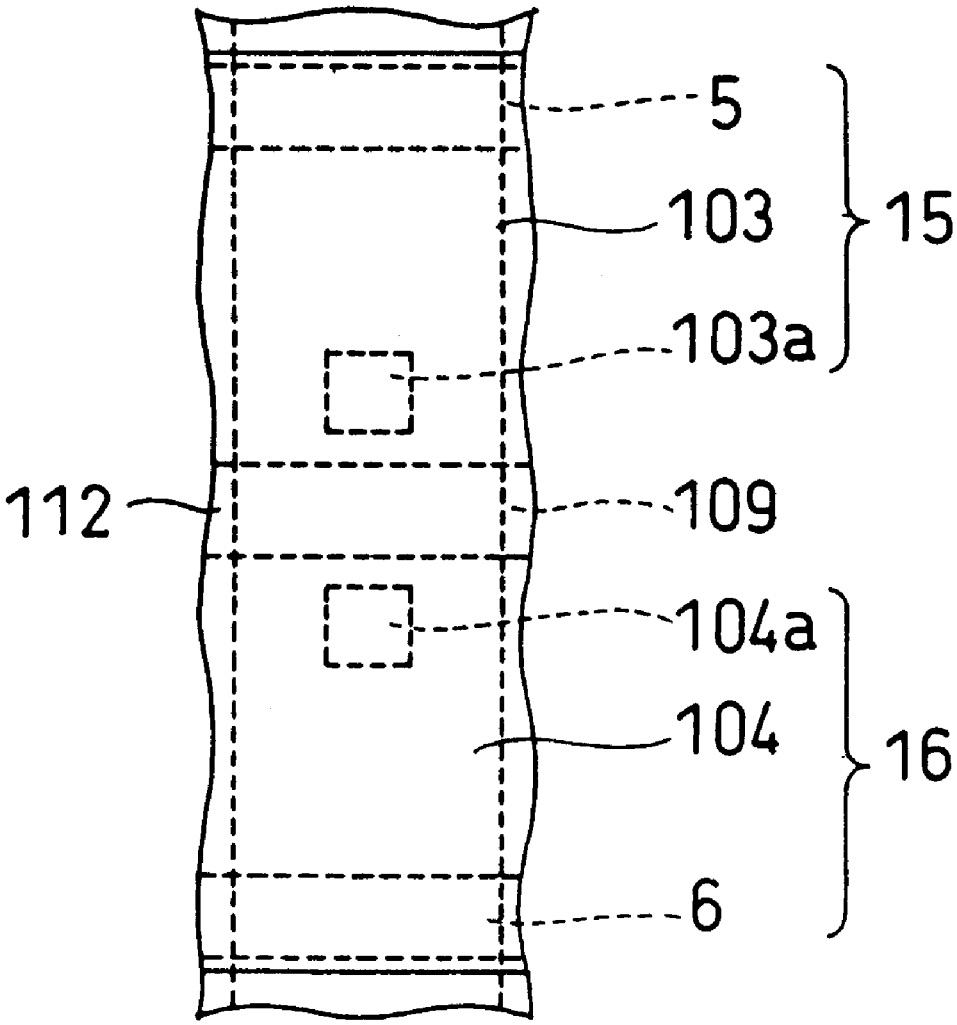
FIG. 19 is a plan view showing the shapes of a scan electrode and a common electrode in a plasma display panel according to a fourth embodiment of the invention.

A fourth embodiment of the present invention will now be described. FIG. 19 is a plan view showing the shapes of a scan electrode and a common electrode in a plasma display panel according to the fourth embodiment. Note that in the fourth embodiment shown in FIG. 19, the same elements as those of the first or second embodiment are denoted by the same reference characters and are not detailed.

According to the fourth embodiment, rectangular island-shaped electrodes 103*a* and 104*a* are provided on transparent electrodes 103 and 104. The island-shaped electrodes 103*a* and 104*a* are made of the same material as that of the transparent electrodes 103 and 104 and have a thickness of at least 5 $\mu$m. The island-shaped electrodes 103*a* and 104*a* are provided in the vicinity of the discharge gap in the center of the width of the display cell such that they do not face the discharge gap. The length and width of the island-shaped electrodes 103*a* and 104*a* are not particularly limited and for example the width is about one fourth of the width of the transparent electrodes 103 and 104.

Whether to form the island-shaped electrode to face or apart from the discharge gap can be determined based on the material of the electrodes. If Ag is used for the material for example to form the island-shaped electrode or bus electrode in a region with a strong electric field, such as a position facing the surface discharge gap, migration is caused at the electrode portion to which the strong field is applied, so that dendrite is sometimes deposited. This phenomenon is common to both the bus electrode and island-shaped electrode. As a result, if a material such as Ag prone to cause dendrite deposition is used for the bus electrode or island-shaped electrode, these electrodes are preferably not formed in a region within 10 $\mu$m of the discharge gap side. However, this does not apply when the discharge gap is large and the field intensity is low.

Regardless of the material used, the electrode may be formed to have a larger thickness so that the threshold voltage for discharge is lowered and the discharge can be prevented from spreading. If the bus electrodes are formed on the discharge gap side, the discharge region can be restrained from spreading in the vertical and horizontal directions. If the discharge cell is large, in other words, if the main scanning line resolution is low, the island-shaped electrode may be formed on the discharge gap side, so that the black luminance by priming discharge can be controlled. Meanwhile, if the discharge cell is small, in other words, if the main scanning line resolution is high, the island-shaped electrode cannot be formed.

Figure 20A:
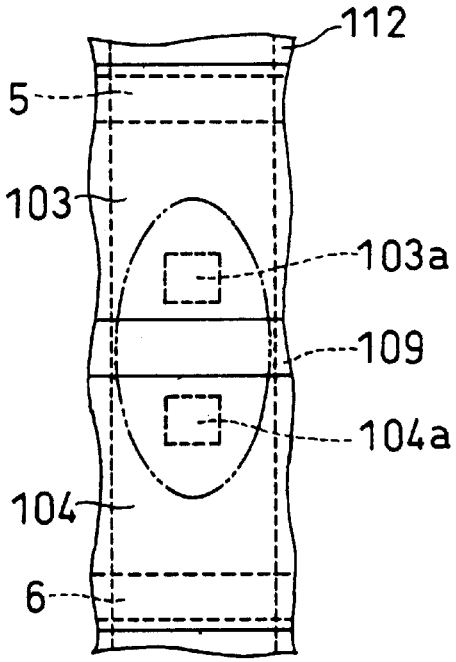
FIGS. 20A to 20C show priming discharge in the fourth embodiment.
Figure 20B:
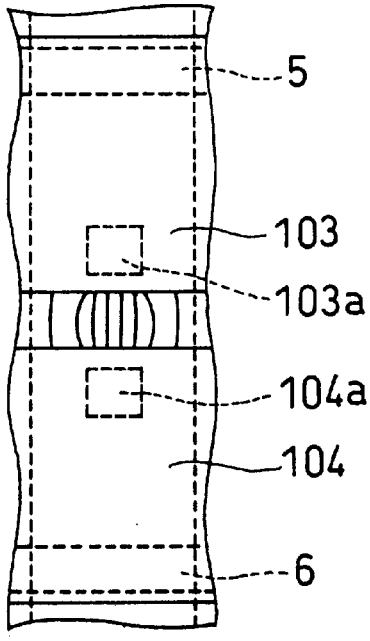
Figure 20C:
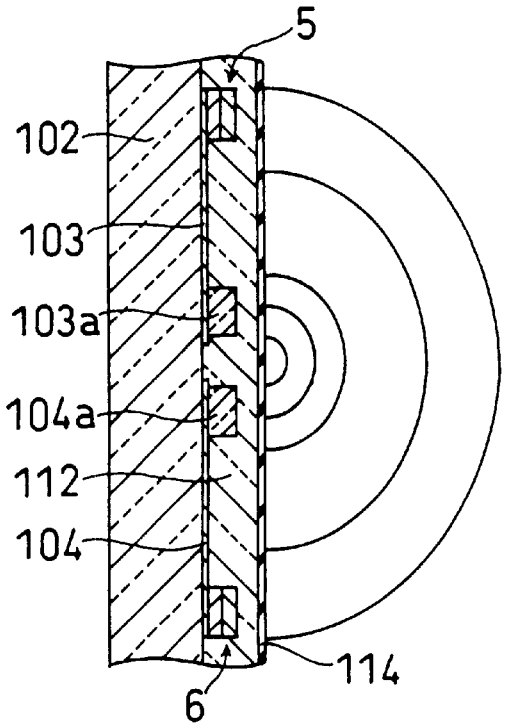

In the fourth embodiment as described above, the priming discharge is generated only in the vicinity of the discharge gap. FIGS. 20A to 20C are views for use in illustration of priming discharge in the fourth embodiment. FIG. 20A is a plan view showing the discharge region, FIG. 20B is a plan view showing the electric line of force, and FIG. 20C is a sectional view showing the electric line of force. Note that the part surrounded by the chain double-dotted line in FIG. 20A is the discharge region.

As shown in FIGS. 20B and 20C, the electric line of force generated by the priming discharge according to the fourth embodiment is dense in the vicinity of the island-shaped electrodes 103*a* and 104*a* and sparse in the periphery of the display cell. As a result, as shown in FIG. 20A, the light emission by the priming discharge concentrates in the center of the display cell, and no light emission is generated in the periphery of the display cell. Therefore, similarly to the second embodiment, the light emission by the priming discharge is extremely weak, the black luminance is lowered, and the contrast improves.

According to the embodiment, there is no bus electrode to shield light emitted in the vicinity of the discharge gap, and therefore peak luminance even higher than the first embodiment is obtained. Consequently, this embodiment is suitably applied to a high definition panel for which high peak luminance is not easily provided.

Furthermore, the electric field concentrates in the vicinity of the discharge gap where discharge is more easily generated. Therefore, the threshold voltage for discharge between the scan electrode 15 and the common electrode 16 is lower than that in the conventional case.

Figure 21:
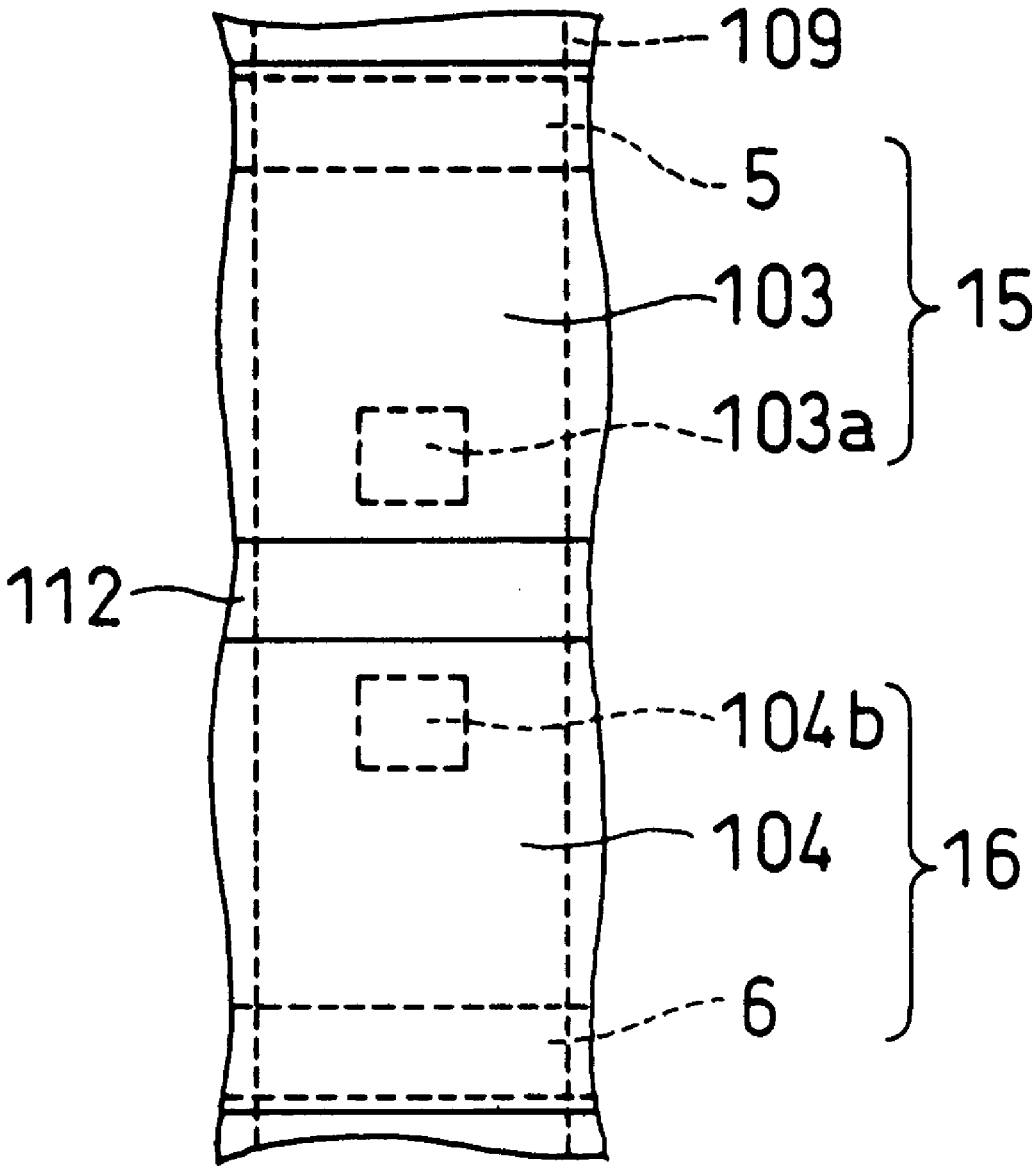
FIG. 21 is a plan view of the shapes of a scan electrode and a common electrode in a plasma display panel according to a fifth embodiment of the invention.

A fifth embodiment of the present invention will now be described. FIG. 21 is a plan view showing the shapes of a scan electrode and a common electrode in a plasma display panel according to the fifth embodiment. Note that in the fifth embodiment shown in FIG. 21, the same elements as those of the first or second embodiment are denoted by the same reference characters and are not be detailed.

According to the fifth embodiment, rectangular island-shaped electrodes 103*b* and 104*b* for example are formed on transparent electrodes 103 and 104, respectively. The island-shaped electrodes 103*b* and 104*b* are both a thin film electrode made of a layered body including a white Ag thin film 7 and a black $RuO_2$ thin film 8 similarly to bus electrodes 5 and 6 and having a thickness of at least 5 $\mu$m, preferably about 7 $\mu$m. The island-shaped electrodes 103*b* and 104*b* have the same two-dimensional shape and are provided in the same position as the island-shaped electrodes 103*a* and 104*a* of the fourth embodiment though not particularly limited to the shape and position.

Figure 22A:
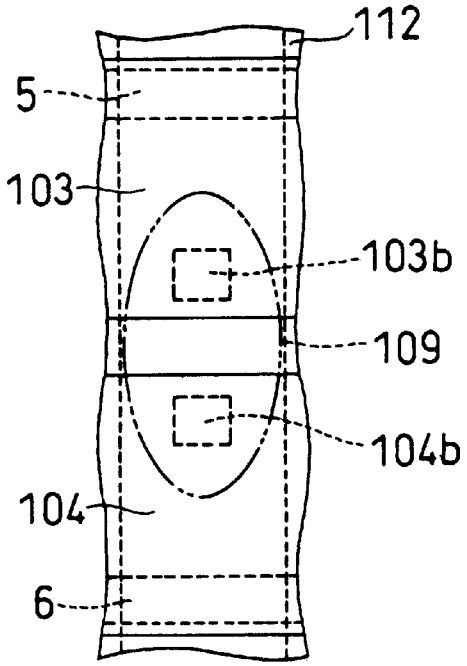
FIGS. 22A to 22C show priming discharge in the fifth embodiment.
Figure 22B:
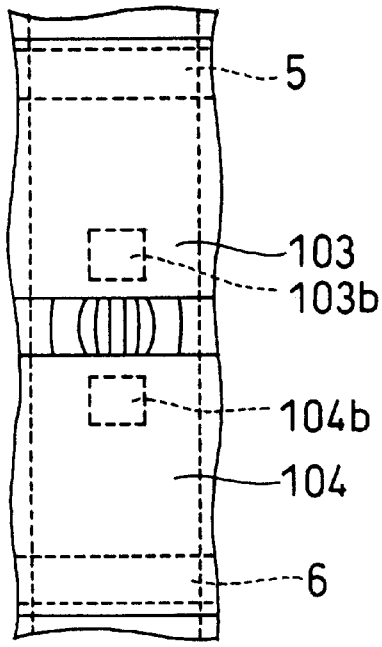
Figure 22C:
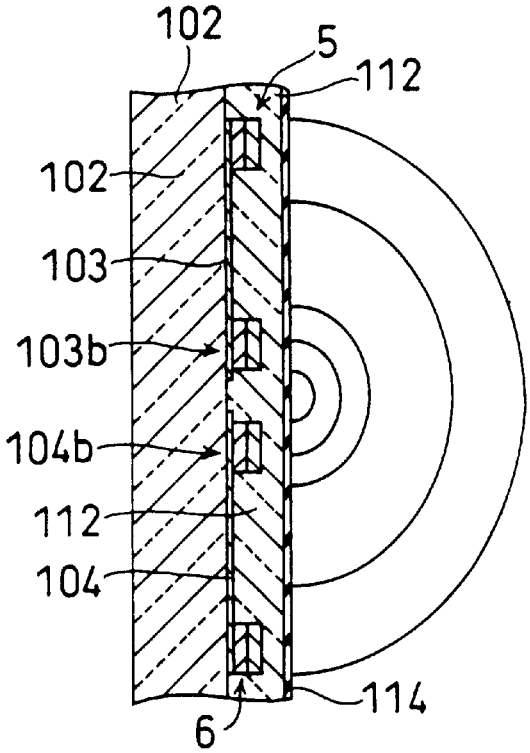

According to the fifth embodiment as described above, priming discharge is generated only in the vicinity of the discharge gap. FIGS. 22A to 22C are views for use in illustration of priming discharge in the fifth embodiment. FIG. 22A is a plan view showing the discharge region, FIG. 22B is a plan view showing the electric line of force, and FIG. 22C is a sectional view showing the electric line of force. Note that the part surrounded by the chain double-dotted line in FIG. 22A is the discharge region.

As shown in FIGS. 22B and 22C, the electric line of force generated by the priming discharge according to the fifth embodiment is dense in the vicinity of the island-shaped electrodes 103*b* and 104*b* and sparse in the periphery of the display cell. As a result, as shown in FIG. 22A, the light emission by the priming discharge concentrates in the center of the display cell, and there is no emission in the periphery of the display cell. Consequently, similarly to the second and fourth embodiments, the light emission by the priming discharge is quite weak, the black luminance is lowered and the contrast is improved.

Also according to the embodiment, similarly to the first embodiment, a large part of the light emitted by localized discharge is shielded by the island-shaped electrodes 103*b* and 104*b*, so that the black luminance can be even lower than that of the fourth embodiment.

In addition, the island-shaped electrodes 103*b* and 104*b* have a layered structure similar to the bus electrodes 5 and 6, and therefore they can be manufactured in the same process. As a result, a mask for patterning needs only be changed, additional steps are not necessary, and the manufacturing cost can be kept down.

The difference between the fourth and fifth embodiments is that whether the island-shaped electrodes are made of the same material as that of the transparent electrodes or that of the bus electrodes. According to the fourth embodiment, the island-shaped electrodes are made of the transparent electrodes, and therefore the peak luminance can be increased. Meanwhile, according to the fifth embodiment, the black luminance can be lowered by the shielding effect of the island-shaped electrodes made of the non-transparent electrodes. In this case, the peak luminance is also lowered, and therefore the contrast might not improve. However, the luminescence intensity in sustaining discharge is almost equal for the entire cell, while light emission by weak discharge concentrates in the vicinity of the discharge gap. Therefore, the light shielding ratio in weak discharge is much larger than that by the island-shaped electrodes in sustaining discharge. Therefore, the contrast greatly increases.

Note that an Indium Tin Oxide (ITO) film, a NESA film, a Cr film, or a Cu film may be used for the island-shaped electrodes.

Figure 23:
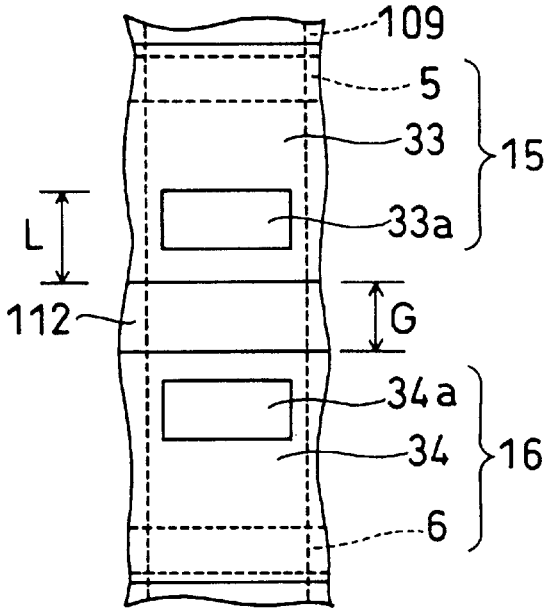
FIG. 23 is a plan view of the shapes of a scan electrode and a common electrode in a plasma display panel according to a sixth embodiment of the invention.

A sixth embodiment of the present invention will now be described. FIG. 23 is a plan view showing the shapes of a scan electrode and a common electrode in a plasma display panel according to the sixth embodiment of the invention. Note that in the sixth embodiment shown in FIG. 23, the elements the same as those of the first or second embodiment are denoted by the same reference characters and are not detailed.

According to the sixth embodiment, similarly to the second embodiment, bus electrodes 5 and 6 are provided in the furthest positions from the surface discharge gap. Transparent electrodes 33 and 34 connected to the bus electrodes 5 and 6, respectively only on a horizontally extended part of a mesh barrier rib structure 9 are provided. The transparent electrodes 33 and 34 are provided with rectangular silts (openings) 33*a* and 34*a*, respectively.

Figure 24:
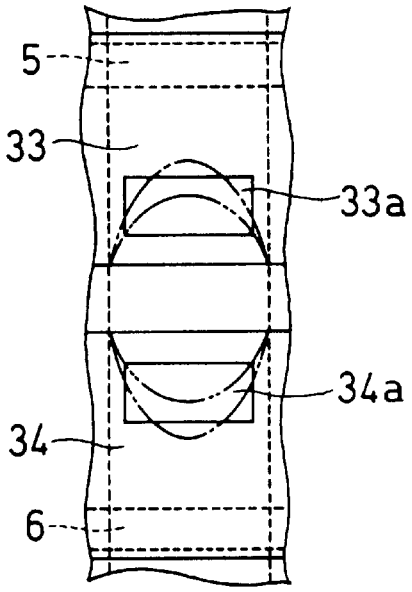
FIG. 24 is a plane view showing a discharge region in priming discharge according to the sixth embodiment.

According to the sixth embodiment as described above, priming discharge is more localized in the vicinity of the discharge gap than that in the conventional case. FIG. 24 is a plane view showing a discharge region in priming discharge according to the sixth embodiment. The part surrounded by the chain double-dotted line in FIG. 24 is the discharge region according to the sixth embodiment, and the part surrounded by the chain single-dotted line is the discharge region without openings. Thus, according to the sixth embodiment, the black luminance is lower than the conventional case, and high contrast is provided.

Note that the distance L between the end of the slit 33*a* and 34*a* on the bus electrode side and the end of the transparent electrodes 33 and 34 on the discharge gap side is 1 to 1.5 times as large as the discharge gap G.

Figure 25:
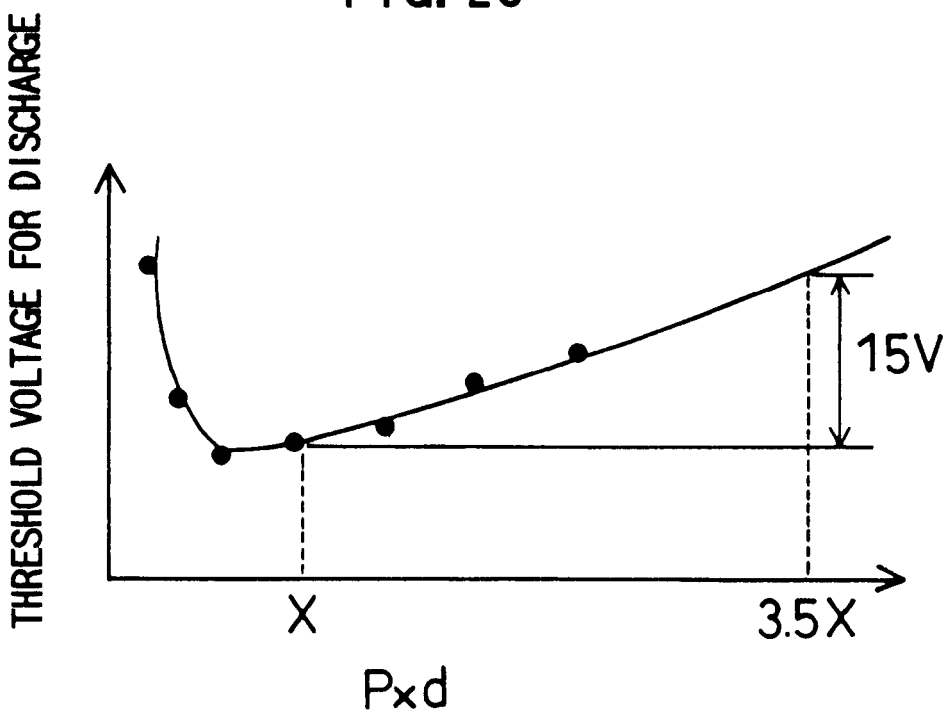
FIG. 25 is a graph representing the relation between the product of the gas pressure in the display cell and the discharge gap (P×d) (at the abscissa) and the threshold voltage for discharge (at the ordinate)

FIG. 25 is a graph representing the relation between the product of the gas pressure in the display cell and the discharge gap (P×d) and the threshold voltage for discharge. The abscissa represents the product, and the ordinate represents the threshold voltage for discharge. Note that in the graph the gas pressure is kept constant. As described above, in the conventional plasma display panel, when the voltage at the scan electrode increases by about 15 V, the product (P×d) is about 3.5 times as large. This shows that the priming discharge extends to be about 3.5 times as long as the discharge gap. Therefore, when a slit is provided such that the end of the transparent electrode on the bus electrode side is in a position at a distance 1.25 times as long as the discharge gap G from the end of the transparent electrode on the discharge gap side, the effective discharge gap is 3.5 times as large. As a result, with a margin taken into account, the slit is provided in a position within the range of 1.5×the discharge gap G, so that high contrast can be obtained while restricting the priming discharge from expanding.

Figure 26A:
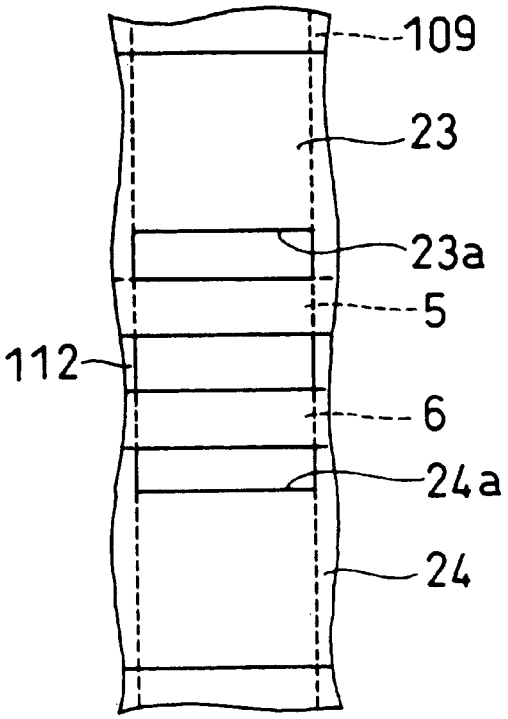
FIGS. 26A and 26B are a plan view and a sectional view respectively, showing the shapes of a scan electrode and a common electrode in a plasma display panel according to a seventh embodiment of the invention.
Figure 26B:
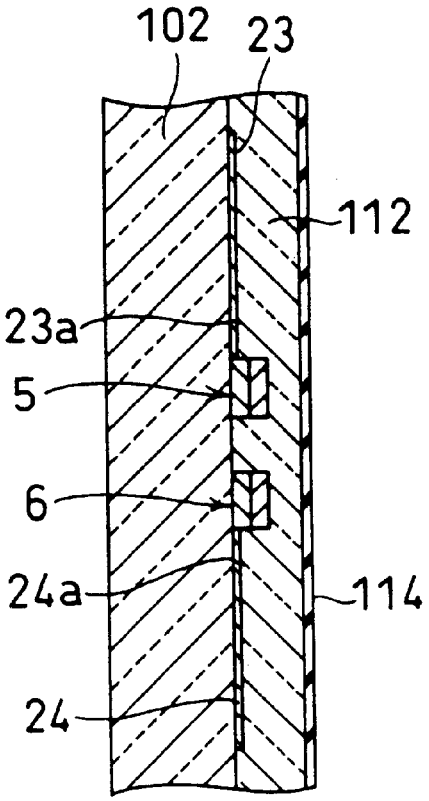

A seventh embodiment of the present invention will now be described. FIGS. 26A and 26B are a plan view and a sectional view, respectively showing the shapes of a scan electrode and a common electrode in a plasma display panel according to the seventh embodiment. Note that in the seventh embodiment shown in FIGS. 26A and 26B, the elements the same as those according to the first or second embodiment are denoted by the same reference characters and are not detailed.

According to the seventh embodiment, similarly to the first embodiment, the bus electrodes 5 and 6 are provided in the vicinity of the discharge gap in the display cell. There are transparent electrodes 23 and 24 connected to the bus electrodes 5 and 6, respectively only on the barrier rib 9. More specifically, on the discharge gap side of the transparent electrodes 23 and 24, there are rectangular slits (openings) 23*a* and 24*a*, respectively.

Figure 27:
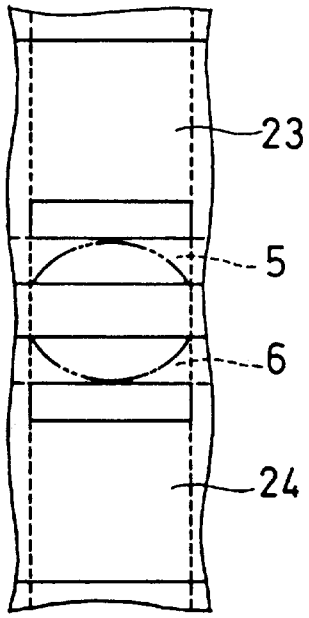
FIG. 27 is a plan view showing a discharge region in priming discharge according to the seventh embodiment.

According to the seventh embodiment as described above, priming discharge is more localized in the vicinity of the discharge gap than that of the first embodiment. FIG. 27 is a plan view showing a discharge region in priming discharge according to the seventh embodiment. Note that the part surrounded by the chain double-dotted line in FIG. 27 is the discharge region. Therefore, the black luminance is lower than that of the first embodiment, and higher contrast is obtained.

Note that according to the second, and fourth to seventh embodiments, there is a stripe barrier rib structure 109, while the mesh barrier rib structure 9 similar to the first embodiment may be provided.

Figure 28:
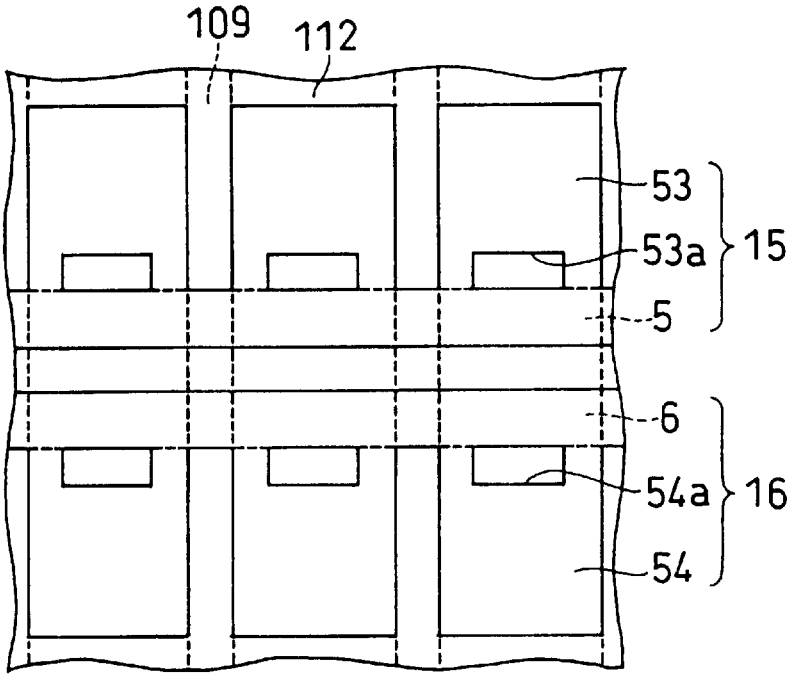
FIG. 28 is a plan view showing the shapes of a scan electrode and a common electrode in a plasma display panel according to an eighth embodiment of the invention.

According to these embodiments, strip-shaped transparent electrodes are provided, and a comb-tooth shaped transparent electrode is provided according to an eighth embodiment. FIG. 28 is a plan view showing the shapes of a scan electrode and a common electrode in a plasma display panel according to the eighth embodiment of the invention. Note that in the eighth embodiment in FIG. 28, the elements the same as those of the first or second embodiment are denoted by the same reference characters and are not detailed.

In the eighth embodiment, as shown in FIG. 28, comb-tooth shaped transparent electrodes 53 and 54 are provided, while slits (openings) 53*a* and 54*a* the same as those of the seventh embodiment are formed for the transparent electrodes 53 and 54, respectively on the basis of one slit for one display cell.

Note that when the comb-tooth shaped transparent electrodes are provided as in the eighth embodiment, the bus electrodes 5 and 6 particularly preferably have a thickness of at least 5 μm. This is because the use of the comb-tooth shaped transparent electrodes improves the luminous efficiency and thus reduces the power consumption, while the peak luminance is slightly lowered, which adversely affects improvement in the contrast to which the present invention is directed. The inventors carried out experiments to examine the relation between the dielectric layer on the transparent electrodes and the threshold voltage for discharge. As a result, it was found that the threshold voltage for discharge increased by about 3 V as the thickness of the dielectric layer increased by 1 μm. Consequently, as described above, when the voltage at the scan electrode increases by 15 V between the start and peak of priming discharge, a thickness difference of at least 5 μm between the parts provided with and without the bus electrode at the dielectric layer can restrain the light emission from expanding with the voltage increase.

Figure 29:
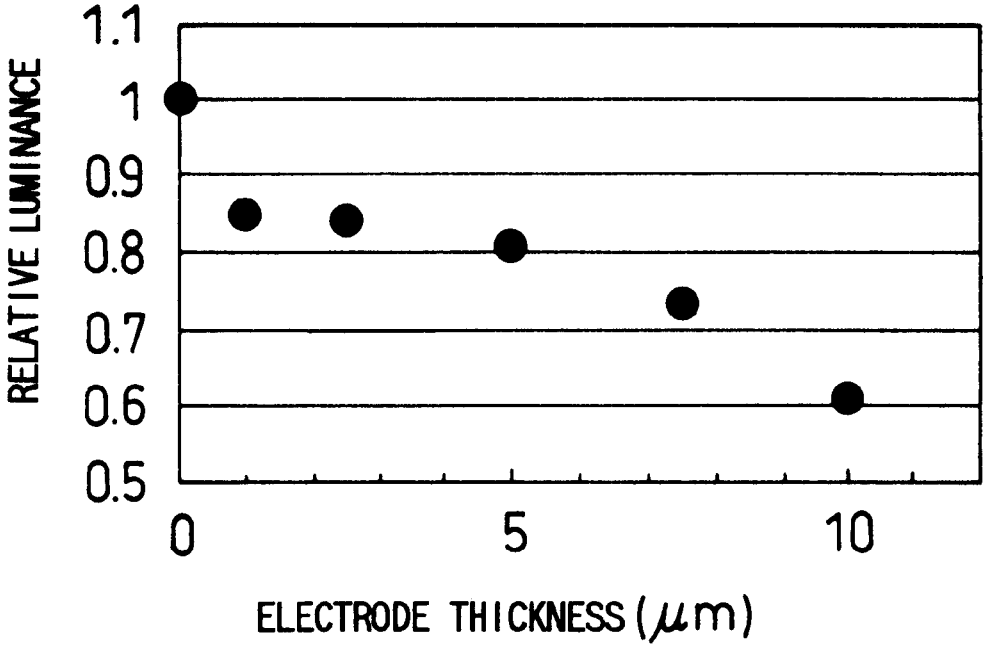
FIG. 29 is a graph representing the relation between the thickness of the electrode on the surface discharge gap side and the relative luminance in the eighth embodiment.

FIG. 29 is a graph representing the relation between the thickness of the electrode on the surface discharge gap side and the relative luminance in the surface discharge electrode according to the eighth embodiment. The abscissa represents the thickness, and the ordinate represents the relative luminance. Note that in FIG. 29, the thickness of the electrode in the conventional structure in FIG. 2 is 0 μm, and the luminance has a relative value of 1 at the time. Similarly to the graph in FIG. 16B, the voltage Vp+ is adjusted to an optimum value, i.e., to the threshold voltage for discharge+ 100 V.

As shown in FIG. 29, similarly to the first embodiment, bus electrodes are provided on the surface discharge gap side, so that the black luminance is significantly reduced. This is mainly because light emission in the priming discharge is more shielded by the bus electrodes. Furthermore, when the bus electrode has a larger thickness such as 5 μm or larger, the black luminance abruptly drops. This is because the priming discharge is more localized in the vicinity of the discharge gap, and the amount of emitted light decreases. At the same time, the emitted light concentrates in the periphery of the bus electrode, which then more effectively shields the light.

Note that not only in the eighth embodiment, but also in the other embodiments, the bus electrode preferably has a thickness of at least 5 μm.

When the comb-tooth shaped transparent electrode is provided, a mesh barrier rib structure 9 is particularly preferably provided. This is because since the peak luminance is slightly lowered and high contrast is not easily provided using the stripe barrier rib structure. More specifically, the use of the mesh barrier rib structure restrains discharge interference in the vertical direction (second direction), so that the non-discharge gap can be reduced. The non-discharge gap is reduced and thus the discharge space is substantially increased. Therefore, higher peak luminance than the case of using the stripe-shaped barrier rib structure and strip-shaped transparent electrodes can be provided. Note that not only in the seventh embodiment, but also in the other embodiments, the mesh barrier rib structure is preferably used.

Figure 30:
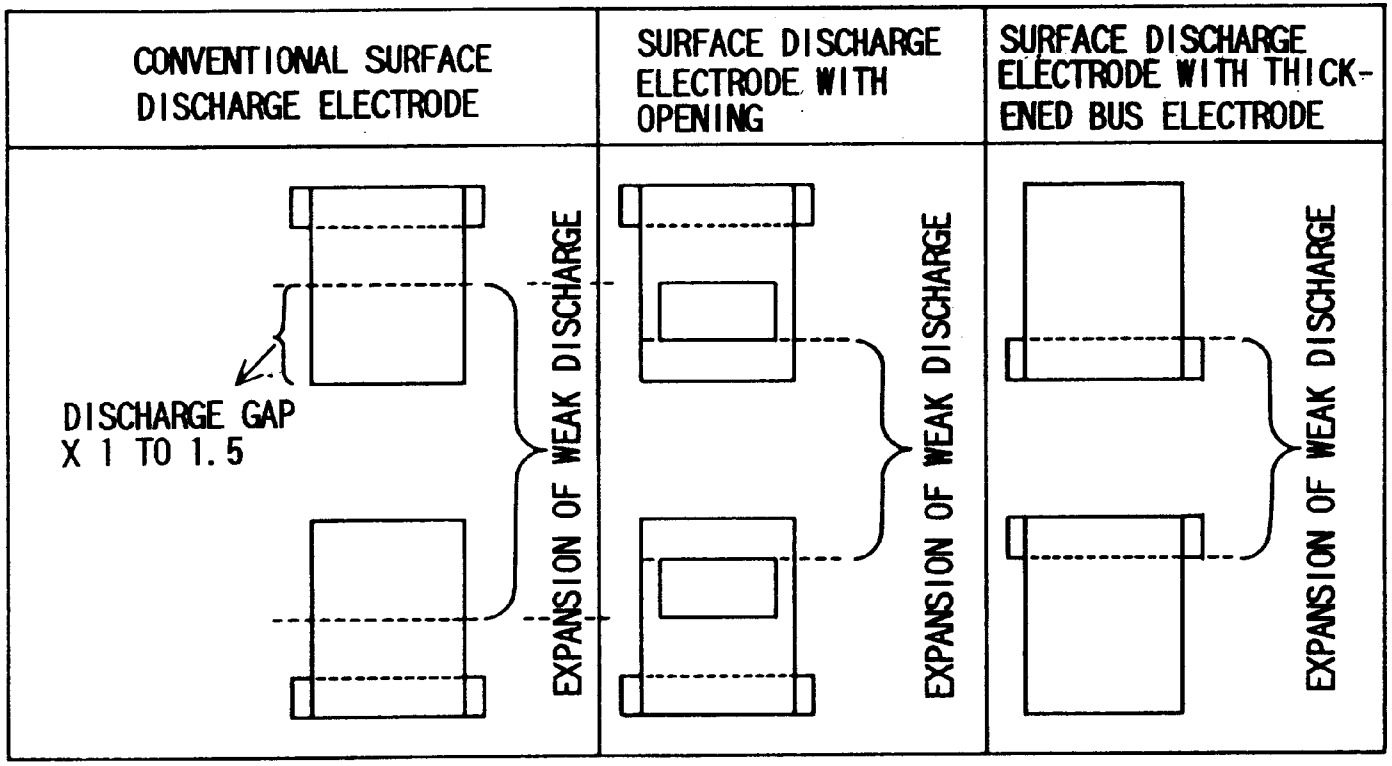
FIG. 30 shows the expansion of weak discharge when a conventional surface discharge electrode, a surface discharge electrode provided with an opening, and a surface discharge electrode with a thickened bus electrode are used.

FIG. 30 shows the effects described above in the form of a table. The conventional surface discharge electrodes, the surface discharge electrodes provided with openings and surface discharge electrodes having thickened bus electrodes are shown. In the case of the conventional surface discharge electrodes, the weak discharge in the priming discharge expands for the distance 1 to 1.5 times as large as the discharge gap each to the scan electrode side and the sustain electrode side. Meanwhile, in the case of the surface discharge electrodes provided with openings, the distance L from the end on the discharge gap side to the end of the opening the further from the discharge gap is set to 1 to 1.5 times as large as the discharge gap. As a result, the weak discharge in the priming discharge can be restrained to the range to the end of the opening on the discharge gap side. In the surface discharge electrodes having thickened electrodes, the thickness of the electrodes in the positions of both surface discharge electrodes facing the discharge gap is increased for example by 5 $\mu$m. The threshold voltage for discharge is lowered by about 3V for each 1 $\mu$m of the thickness of the electrode. As a result, when the thickness is increased by 5 $\mu$m, the threshold voltage for discharge is lowered by about 15 V. The value corresponds to the expansion of the weak discharge in the priming discharge for the distance 1 to 1.5 times as long as discharge gap from the ends on the discharge gap side to the scan electrode side and the sustain electrode side. As a result, the expansion of the weak discharge in the priming discharge can be restrained to the end of the surface discharge electrode having a thickened electrode opposite to the discharge gap.

It is generally known that an electrode in the region within about 50 $\mu$m of the discharge gap greatly affects the threshold voltage for discharge. *The Technical Report of The Proceeding of The Institute of Electronics, Information and Communication Engineers*, vol. EID 98-98, p. 110, January 1991 describes about the effect.

At the present manufacturing level, the minimum line width for a bus electrode produced by sequentially placing a Cr film, a Cu film and a Cr film upon one another is around 50 $\mu$m. Meanwhile, the minimum line width by the photosensitive Ag paste method is around 70 $\mu$m.

In a 40-inch PDP for practical application, the line resistance value of a bus electrode must be 100 Ω or less. This is because above 100 Ω, effective application voltage is greatly different between at the display cell where discharge is started and at the display cell where discharge is generated lastly because of voltage drop at the time of discharge. This causes luminance unevenness and color unevenness. The color unevenness is caused because the difference in the threshold voltage for discharge between the colors is emphasized.

Therefore, the width of the bus electrode is determined in consideration of the balance between the processing capability in the manufacture and the line resistance value. According to an often employed conventional method, the electrode width is set to the minimum line width allowed by the processing capability, and the thickness of the electrode is adjusted accordingly. Thus, the line resistance value is controlled.

Now, the effect caused by increasing the thickness of the bus electrode will now be described. If the thickness of the bus electrode is as thin as possible, the expansion of discharge would be about as large as that of the conventional case. If the bus electrode has a thickness in the range from 0 to 5 $\mu$m, the dielectric layer absorbs the thickness difference between the electrodes, so that the expansion of the discharge would be almost the same as that of the conventional case.

If the thickness of the bus electrode is 5 $\mu$m or more, the dielectric layer can no longer completely absorb the thickness difference between the electrodes, and the expansion of the discharge is extremely small. This can be seen from the graph in FIG. 29 in which the relative luminance abruptly drops when the electrode thickness is 5 $\mu$m or more. As shown in FIG. 30, when the thickness of the bus electrode is large enough, the expansion of the discharge stops substantially at the bus electrodes. Therefore, in consideration of the present processing capability in the manufacture, when the thickness of the bus electrode formed by sequentially placing a Cr film, a Cu film, and a Cr film on one another or the thickness of the bus electrode by the photosensitive Ag paste method is at least 5 $\mu$m, the expansion of the discharge stops substantially at the bus electrodes.

Figure 31:
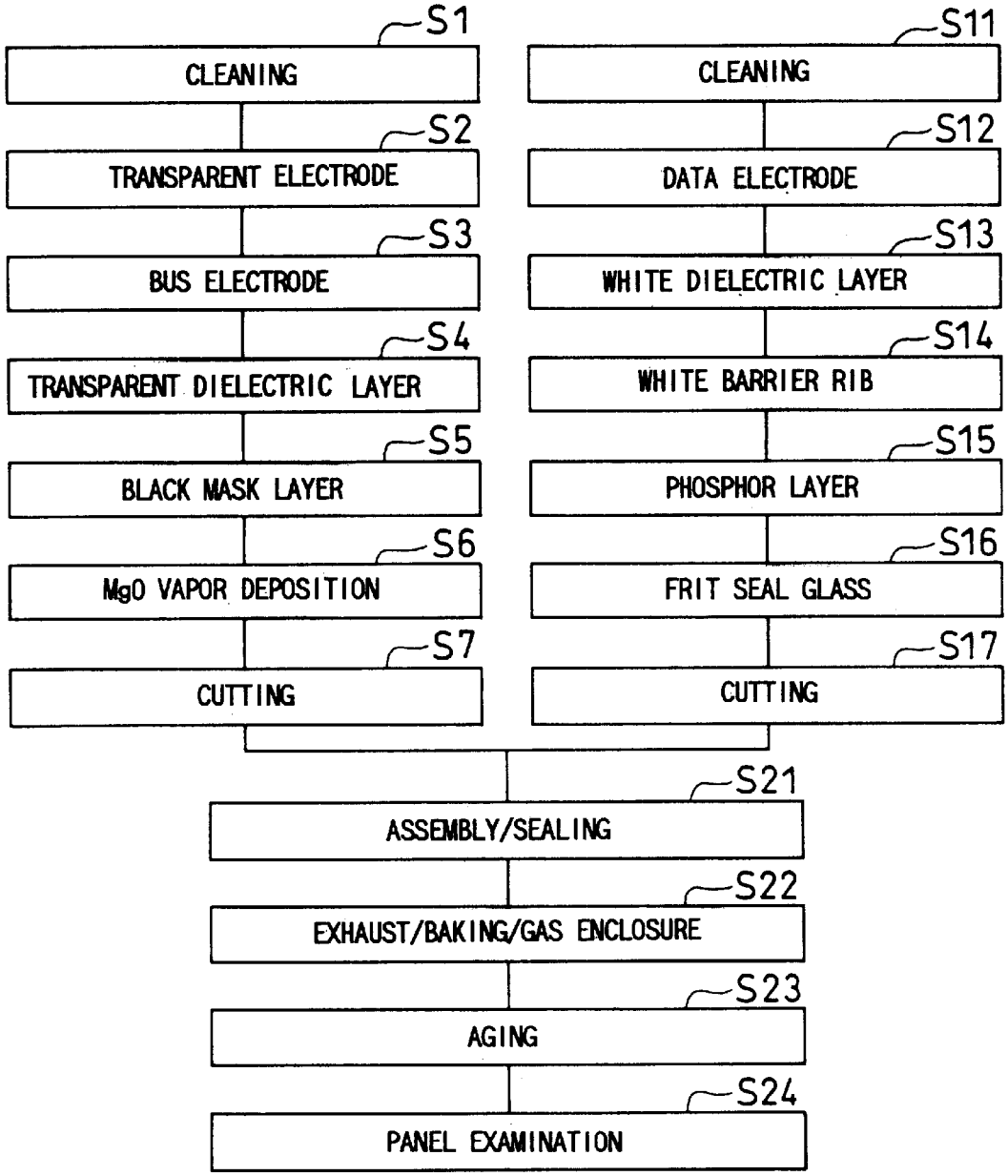
FIG. 31 is a flowchart for use in illustration of a method of producing the plasma display panel according to the first embodiment.

A method of manufacturing the plasma display panel according to the first embodiment will now be described. FIG. 31 is a flowchart for use in illustration of the manufacturing method.

A glass sheet substrate which can be cut into a plurality of transparent substrates 102 is cleaned (step S1). The cleaning step includes three steps of cleaning, pre-baking, and cleaning. Then, a transparent electrode is formed on the sheet substrate (step S2). The step includes three steps of printing, exposing and developing a material such as ITO. Bus electrodes of two thin film layers are then formed in the vicinity of the discharge gap (step S3). A transparent dielectric layer is then formed on the entire surface (step S4), and a black mask layer made of a mesh-or stripe-black barrier rib structure and improving the contrast is formed thereon (step S5). A MgO film is then vapor-deposited on the entire surface (step S6), and the sheet substrate is cut into transparent electrodes 102 (step S7). The front panel substrate is thus produced.

A glass sheet substrate which can be cut into a plurality of transparent substrates 101 is cleaned (step S11). The cleaning step includes three steps of cleaning, pre-baking, and cleaning. A data electrode is then formed on the sheet substrate (step S12). In the step, a material is printed and developed. Then, a white dielectric layer is formed on the entire surface (step S13), and a mesh-shaped white barrier rib structure is formed thereon (step S14). Phosphor layers emitting three primary colors, red, blue, and green are applied on a bottom part of the groove formed by the white dielectric layer and the white barrier rib structure (step S15). Frit seal glass is formed in a prescribed position (step S16), and the sheet substrate is cut into transparent substrates 101 (step S17). Thus, the back panel substrate is manufactured.

The front panel substrate and the back panel substrate are placed on one another, assembled, and then heated, so that the frit seal glass is fused for sealing (step S21). The exhaust in the panel is let out through an exhaust pipe provided at the back panel substrate while heating (baking), and the discharge gas is enclosed inside (step S22). The display panel is then subjected to aging (step S23), and the panel is examined (step S24).

When a plasma display panel according to the second, third, sixth, seventh or eighth embodiment is manufactured, the shape of the transparent electrodes or the position of the bus electrodes needs only be changed. Meanwhile, when a plasma display panel according to the fourth embodiment is manufactured, the step of forming rectangular transparent electrodes is provided after forming the transparent electrodes. When a plasma display panel according to the fifth embodiment is manufactured, the mask pattern at the time of forming the bus electrodes needs only be changed, so that additional steps are not necessary.

Figure 32:
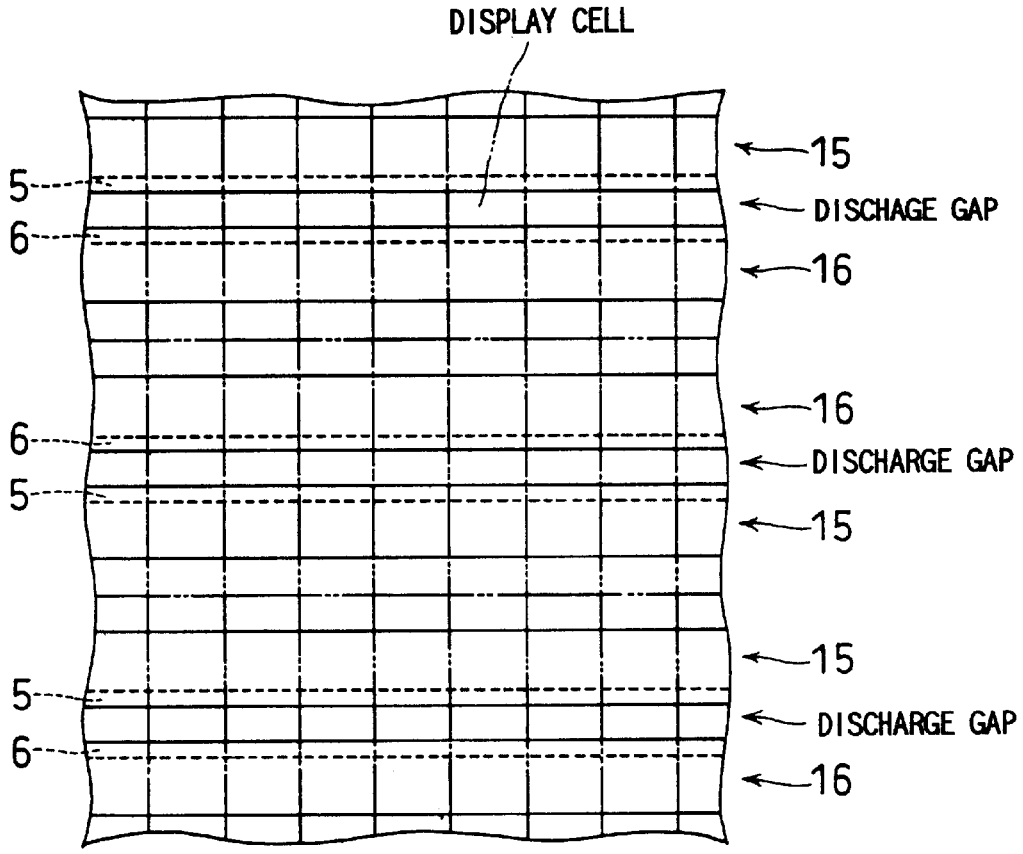
FIG. 32 is a plan view of an arrangement of scan electrodes and common electrodes.

The arrangement of the scan electrode and the common electrode may be the same for each display cell or the positions of the scan electrode and the common electrode may be reversed for each display row. FIG. 32 is a plan view showing an arrangement of scan electrodes and common electrodes. As shown in FIG. 32, the arrangement of scan electrodes 15 and the common electrodes 16 is reversed between adjacent display rows, while the distance between the bus electrodes 5 and 6 and the discharge gap are substantially constant. Therefore, there is no image disturbance such as moiré.

As for a method of driving the plasma display panels according to these embodiments, as long as the method requires application of a priming pulse having a blunt waveform (such as a ramp voltage having a voltage gradient of 7.5 V/$\mu$sec or less) in a priming period, the other conditions are not specifically limited. For example, progressive display or interlace display may be employed.

Figure 3:
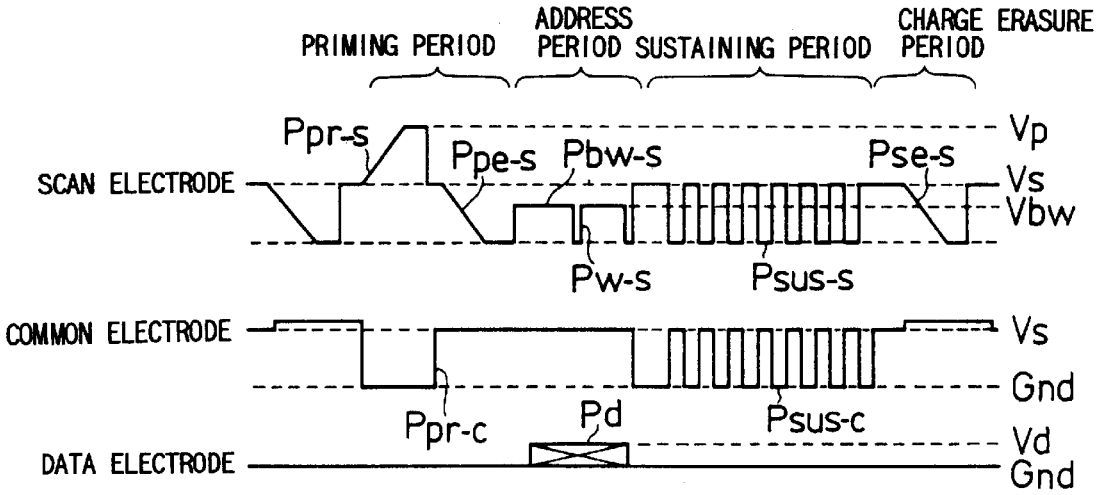
FIG. 3 (PRIOR ART)
FIG. 3 is a timing chart for use in illustration of writing selective type driving operation in the conventional plasma display panel.
Figure 4A:
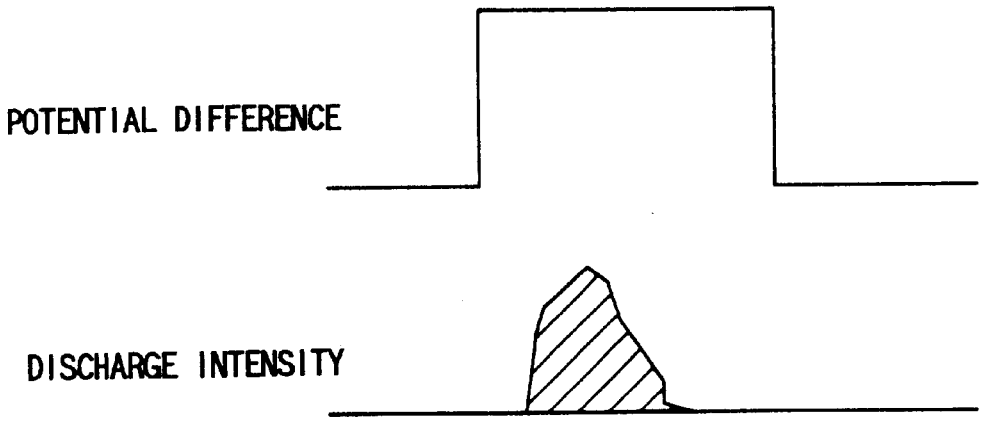
FIG. 4A (PRIOR ART)
FIGS. 4A and 4B are timing charts for use in illustration of the relation between the potential difference between surface discharge electrodes and the discharge intensity.
Figure 4B:
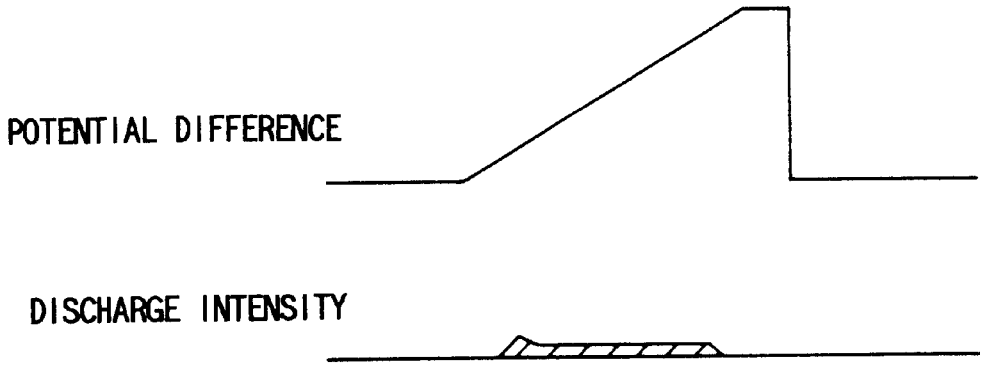
FIG. 4B (PRIOR ART)
Figure 33:
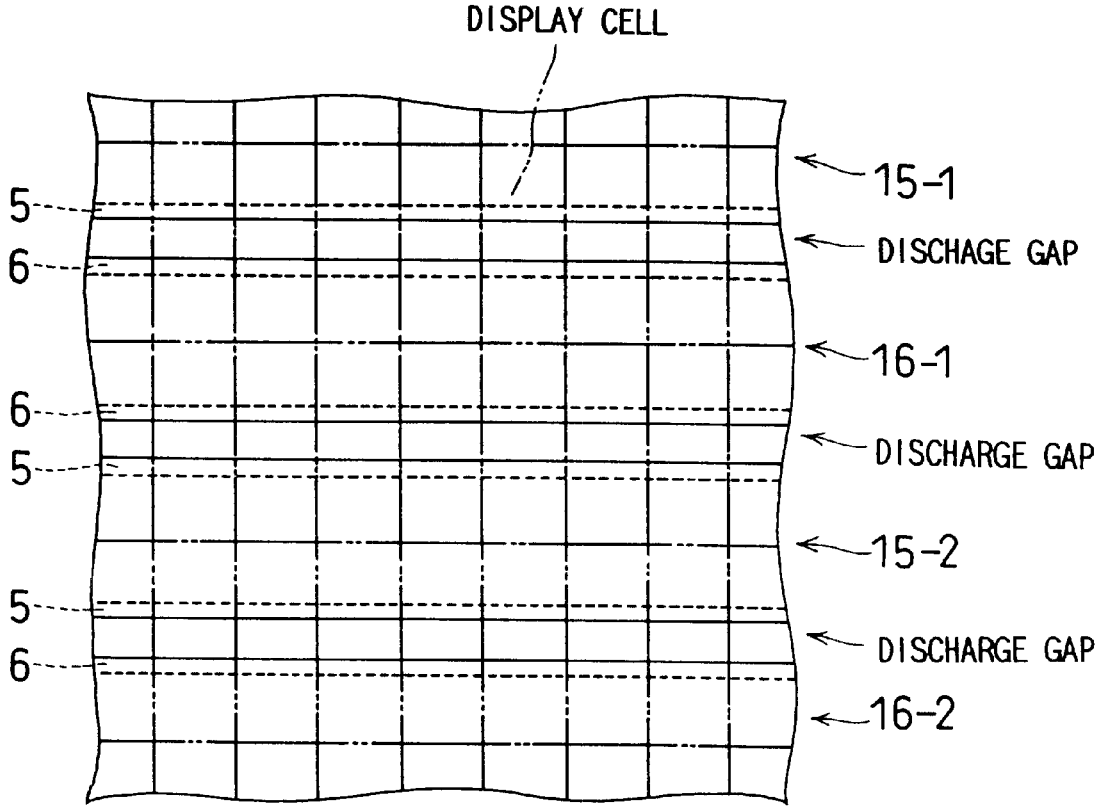
FIG. 33 is a plan view of a plasma display panel for interlace display.

FIG. 33 is a plan view of a plasma display panel for interlace display. In the plasma display panel, the scan electrode 15 or the common electrode 16 is shared between adjacent display rows. In a priming period, similarly to the driving method as shown in FIG. 3, a priming pulse is applied to each scan electrode 15, while the potential of the common electrode 16 is held in the ground level. Meanwhile, in a sustaining period, the waveform of a sustaining pulse is changed for each field. For example, in an odd-numbered field, sustaining pulses in phase are applied to the scan electrode 15-1 and the common electrode 16-2, while sustaining pulses in opposite phases are applied to the common electrode 16-1 and the scan electrode 15-2. In an even numbered field, sustaining pulses in phase are applied to the scan electrode 15-1 and the common electrode 16-1, and sustaining pulses in opposite phases are applied to the common electrode 16-2 and the scan electrode 15-2. As a result, in the odd-numbered field, sustaining light emission is generated between the scan electrode 15-1 and the common electrode 16-1 and between the scan electrode 15-2 and the common electrode 16-2, while in the even-numbered field, sustaining light emission is generated between the scan electrode 15-2 and the common electrode 16-1.

The layered structure of the bus electrodes is not specifically limited, and the thickness ratio of the Ag thin film 7 and the black $RuO_2$ thin film 8 can for example be 2:1. The materials are not limited to the above, while they are preferably formed by coating rather than vapor-deposition to have an increased thickness.

The three-layer structure including a Cr layer, a Cu layer, and a Cr layer is used for the conventional bus electrode. For the bus electrode, a Cu film is used as a high conductive material, and a Cr film is provided as an underlying film to keep the Cu film and the glass substrate in close contact. A Cr layer is provided on the Cu layer in order to restrain the reaction between the Cu and low melting point glass when the low melting point glass as a transparent dielectric layer is baked.

When the conventional bus electrode as described above is formed, the Cr layer, the Cu layer, and the Cr layer are sequentially formed on the glass substrate by sputtering, and a resist film having a prescribed pattern is formed by photolithography. Etching is then sequentially performed from the upper Cr layer and on, and then the resist film is removed.

The photoetching process includes numerous steps, and it is relatively difficult to secure large thickness because sputtering is employed for forming the films, in other words, it is extremely difficult to form a film having a thickness of several micrometers or more. Therefore, the method is not suitable for mass production. Furthermore, the method requires a large-size vacuum system, which pushes up the cost. Meanwhile, a fine bus electrode can more easily be formed by the method than the other methods.

Meanwhile, when photosensitive Ag paste is used, a bus electrode can be formed by a method using an inexpensive apparatus such as screen printing, and therefore the method is advantageous in terms of cost in particular as compared to the other methods using the vacuum film forming apparatus. A relatively large thickness can extremely easily be secured, and therefore the method is preferable when a thickness of 5 $\mu$m or more is necessary. Furthermore, the necessary number of steps is small, which is advantageous in the manufacture. When the bus electrode is manufactured, photosensitive Ag paste for example is printed on the entire surface of a glass substrate and dried. A ultraviolet beam may then be irradiated thereon in a prescribed pattern for exposure, followed by development with an alkaline aqueous solution, drying and baking.

Figure 34:
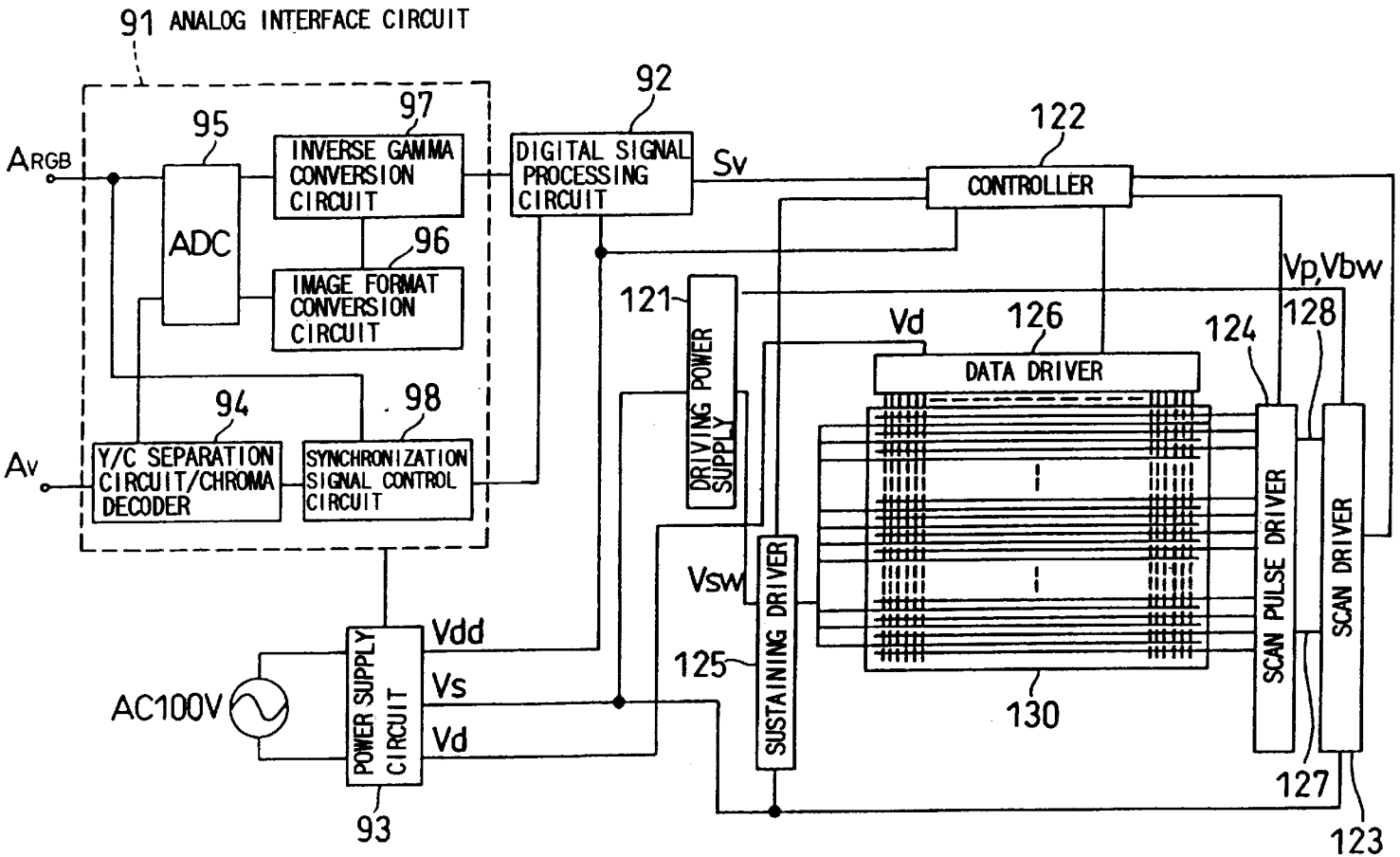
FIG. 34 is a block diagram of the configuration of a plasma display to which the present invention is applied.

Note that the plasma display according to the present invention may be used as a display such as for a TV receiving set or a monitor for a computer. FIG. 34 shows the configuration of a plasma display (PDP multi-media monitor) to which the present invention is applied. The plasma display includes as driving circuit for a PDP 130, a sustaining driver 125 connected to a sustain electrode, a scan pulse driver 124 connected to a scan electrode, a scan driver 123 connected to the preceding stage, a data driver 126 connected to a data electrode, a driving power supply 121 supplying power supply voltage to these elements, and a controller 122 controlling the operations of these elements. There are an analog interface circuit 91 and a digital signal processing circuit 92 in the preceding stage. There is also a power supply circuit 93 to supply DC voltage from an AC voltage of 100 V to the parts of the apparatus. The analog interface circuit 91 includes a Y/C separation circuit/chroma decoder 94, an analog-digital converter (ADC) 95, an image format conversion circuit 96, an inverse gamma conversion circuit 97, and a synchronization signal control circuit 98.

The Y/C separation circuit/chroma decoder 94 is a circuit used to decompose an analog vide signal $A_V$ into red (R), green (G), and blue (B) luminance signals when the display is used as a display portion in a TV receiving set. The ADC 95 converts an analog RGB signal $A_{RGB}$ into a digital RGB signal when the display is used as a monitor for a computer. The ADC 95 converts R, G, and B luminance signals supplied from the Y/C separation circuit/chroma decoder 94 into digital R, G, B luminance signals when the display is used as a display portion in a TV receiving set.

The image format conversion circuit 96 converts the pixel arrangement of the digital R, G, and B luminance signals supplied from ADC 95 to be adapted to the pixel arrangement of the PDP 130 when the pixel arrangements are different from one another. The inverse gamma conversion circuit 97 performs inverse gamma correction to the digital RGB signal which has been gamma-corrected to be adapted to the gamma characteristic of the CRT display or the digital R, G, and B luminance signals from the image format conversion circuit 96, so that their characteristics are adapted to the linear gamma characteristic of the PDP 130. The synchronization signal control circuit 98 generates a sampling clock signal or a data clock signal for the ADC 95 based on an analog video signal $A_V$ and a horizontal synchronization signal supplied at the same time. A video signal $S_V$ is output from the digital signal processing circuit 92 to the controller 122.

Note that the power supply circuit 93 generates logical voltage Vdd, data voltage Vd and sustaining voltage Vs from an AC voltage of 100 V, and the driving power supply 121 generates priming voltage Vp, scan base voltage Vbw, bias voltage Vsw and data voltage Vd based on the sustaining voltage Vs supplied from the power supply circuit 93. The PDP 130, the controller 122, the driving power supply 121, the scan driver 123, the scan pulse driver 124, the sustaining driver 125, the data driver 126 and the digital signal processing circuit 92 are modularized. Such a plasma display is applicable to any of the above embodiments.

As in the foregoing, according to the present invention, the black luminance is lowered, while the peak luminance by the light emission in sustaining discharge can be improved. Therefore, the contrast can be improved. Since wall charge is more easily formed in the vicinity of the discharge gap, the transition from the opposed discharge to the surface discharge can easily take place. The threshold voltage for discharge in sustaining discharge or writing discharge can be reduced. Consequently, the power consumption can be reduced.

What is claimed is:

1. A plasma display panel, comprising:

first and second substrates placed opposed to each other;

a plurality of scan electrodes and common electrodes provided on the surface side of said first substrate facing said second substrate and extending in a first direction; and a plurality of data electrodes provided on the surface side of said second substrate facing said first substrate and extending in a second direction orthogonal to said first direction, a display cell being provided each at the crossing point of said scan electrode and common electrode and said data electrode, driving voltage increased with time being applied to said scan electrode in a priming period, said scan electrode and said common electrode comprising:

a transparent electrode; and a bus electrode formed on the transparent electrode more on the side of a discharge gap than the center thereof, extending in said first direction and shielding light emitted in said display cell by said applied driving voltage.

2. The plasma display panel according to claim 1, wherein said transparent electrode is shared between display cells arranged in said first direction.

3. The plasma display panel according to claim 1, wherein said transparent electrode is separately provided for each said display cell, and has a comb-tooth shape when viewed two-dimensionally.

4. The plasma display panel according to claim 1, wherein said transparent electrode has an opening formed for each said display cell.

5. The plasma display panel according to claim 4, wherein said opening is formed in contact with said bus electrode when viewed two-dimensionally.

6. The plasma display panel according to claim 1, wherein said transparent electrode is without an opening.

7. The plasma display panel according to claim 1, wherein said bus electrode has a thickness of at least 5 $\mu$m.

8. The plasma display panel according to claim 1, wherein said bus electrode has a black first electrode formed on said transparent electrode, and a second electrode formed on the first electrode and containing Ag.

9. The plasma display panel according to claim 1, wherein in a sustaining period, sustaining pulses in phase are applied to one of said scan electrodes and common electrodes between adjacent display cells in said second direction, and interlace display is provided.

10. The plasma display panel according to claim 1, wherein the relative positional relation between said scan electrodes and said common electrodes is reversed between adjacent cells in said second direction.

11. The plasma display panel according to claim 1, further comprising a mesh barrier rib structure formed on said second substrate for separating said display cells.

12. The plasma display panel according to claim 1, further comprising a mesh barrier rib structure formed on said second substrate for separating said display cells.

13. The plasma display panel according to claim 1, wherein in said scan electrode and sustain electrode, a region at least 10 $\mu$m apart from the side end of said scan electrode and sustain electrode facing the discharge gap is made of one selected from the group consisting of an indium tin oxide film, a NESA film, a Cr film, and a Cu film.

14. A plasma display, comprising a plasma display panel according to claim 1.

15. A plasma display panel, comprising:

first and second substrates placed opposed to each other;

a plurality of scan electrodes and common electrodes provided on the surface side of said first substrate facing said second substrate and extending in a first direction; and a plurality of data electrodes provided on the surface side of said second substrate facing said first substrate and extending in a second direction orthogonal to said first direction, a display cell being provided each at the crossing point of said scan electrode and common electrode and said data electrode, driving voltage increased with time being applied to said scan electrode in a priming period, said scan electrode and common electrode comprising a transparent electrode and a bus electrode formed on the transparent electrode and extending in said first direction, said transparent electrode comprising a base portion and a projection jutting out from the base portion to another transparent electrode within the same display cell.

16. The plasma display panel according to claim 15, wherein the area of said projection when viewed two-dimensionally is in the range from 10% to 50% of the value produced by W×H, where W represents the width of said display cell, and H represents the distance between the top of said projection and said base portion.

17. The plasma display panel according to claim 16, wherein the length of the side end of said projection forming the shortest discharge gap is substantially equal to the length of the side end of said projection in contact with said base portion.

18. The plasma display panel according to claim 15, wherein said bus electrode has a thickness of at least 5 μm.

19. The plasma display panel according to claim 15, wherein said bus electrode has a black first electrode formed on said transparent electrode, and a second electrode formed on the first electrode and containing Ag.

20. The plasma display panel according to claim 15, wherein in a sustaining period, sustaining pulses in phase are applied to one of said scan electrodes and common electrodes between adjacent display cells in said second direction, and interlace display is provided.

21. The plasma display panel according to claim 15, wherein the relative positional relation between said scan electrodes and said common electrodes is reversed between adjacent cells in said second direction.

22. The plasma display panel according to claim 15, further comprising a mesh barrier rib structure formed on said second substrate for separating said display cells.

23. The plasma display panel according to claim 15, further comprising a mesh barrier rib structure formed on said second substrate for separating said display cells.

24. The plasma display panel according to claim 15, wherein in said scan electrode and sustain electrode, a region at least 10 μm apart from the side end of said scan electrode and sustain electrode facing the discharge gap is made of one selected from the group consisting of an indium tin oxide film, a NESA film, a Cr film, and a Cu film.

25. A plasma display, comprising a plasma display panel according to claim 15.

26. A plasma display panel, comprising:

first and second substrates placed opposed to each other;

a plurality of scan electrodes and common electrodes provided on the surface side of said first substrate facing said second substrate and extending in a first direction; and a plurality of data electrodes provided on the surface side of said second substrate facing said first substrate and extending in a second direction orthogonal to said first direction, a display cell being provided each at the crossing point of said scan electrode and common electrode and said data electrode, driving voltage increased with time being applied to said scan electrode in a priming period, said scan electrode and common electrode comprising a transparent electrode, a bus electrode formed on the transparent electrode and extending in said first direction and an island-shaped electrode formed on said transparent electrode more on the discharge gap side than the center thereof.

27. The plasma display panel according to claim 26, wherein said island-shaped electrode is made of the same material as that of said bus electrode, and has a thickness of at least 5 μm.

28. The plasma display panel according to claim 27, wherein said island-shaped electrode is made of the same material as that of said transparent electrode and has a thickness of at least 5 μm.

29. The plasma display panel according to claim 28, wherein said island-shaped electrode faces the discharge gap.

30. A method of manufacturing a plasma display panel according to claim 28, comprising the steps of:

forming said transparent electrode on said second substrate;

forming a material film for said bus electrode and island-shaped electrode on said transparent electrode; and patterning said material film, thereby forming said bus electrode and said island-shaped electrode at a time.

31. The plasma display panel according to claim 26, wherein said island-shaped electrode is made of one selected from the group consisting of an indium tin oxide film, a NESA film, a Cr film and a Cu film and faces the discharge gap.

32. The plasma display panel according to claim 26, wherein said bus electrode has a thickness of at least 5 μm.

33. The plasma display panel according to claim 26, wherein said bus electrode has a black first electrode formed on said transparent electrode, and a second electrode formed on the first electrode and containing Ag.

34. The plasma display panel according to claim 26, wherein in a sustaining period, sustaining pulses in phase are applied to one of said scan electrodes and common electrodes between adjacent display cells in said second direction, and interlace display is provided.

35. The plasma display panel according to claim 26, wherein the relative positional relation between said scan electrodes and said common electrodes is reversed between adjacent cells in said second direction.

36. The plasma display panel according to claim 26, further comprising a mesh barrier rib structure formed on said second substrate for separating said display cells.

37. The plasma display panel according to claim 26, further comprising a mesh barrier rib structure formed on said second substrate for separating said display cells.

38. The plasma display panel according to claim 26, wherein in said scan electrode and sustain electrode, a region at least 10 μm apart from the side end of said scan electrode and sustain electrode facing the discharge gap is made of one selected from the group consisting of an indium tin oxide film, a NESA film, a Cr film, and a Cu film.

39. A plasma display, comprising a plasma display panel according to claim 26.

40. A plasma display panel, comprising:

first and second substrates placed opposed to each other;

a plurality of scan electrodes and common electrodes provided on the surface side of said first substrate facing said second substrate and extending in a first direction; and a plurality of data electrodes provided on the surface side of said second substrate facing said first substrate and extending in a second direction orthogonal to said first direction, a display cell being provided each at the crossing point of said scan electrode and common electrode and said data electrode, driving voltage increased with time being applied to said scan electrode in a priming period, said scan electrode and common electrode comprising a transparent electrode and a bus electrode formed on the transparent electrode and extending in said first direction, said transparent electrode having an opening having its end on the non-discharge gap side located in a position apart from its end on the discharge gap side by a distance 1 to 1.5 times as large as the discharge gap.

41. The plasma display panel according to claim 40, wherein said bus electrode has a thickness of a least 5 $\mu$m.

42. The plasma display panel according to claim 40, wherein said bus electrode has a black first electrode formed on said transparent electrode, and a second electrode formed on the first electrode and containing Ag.

43. The plasma display panel according to claim 40, wherein in a sustaining period, sustaining pulses in phase are applied to one of said scan electrodes and common electrodes between adjacent display cells in said second direction, and interlace display is provided.

44. The plasma display panel according to claim 40, wherein the relative positional relation between said scan electrodes and said common electrodes is reversed between adjacent cells in said second direction.

45. The plasma display panel according to claim 40, further comprising a mesh barrier rib structure formed on said second substrate for separating said display cells.

46. The plasma display panel according to claim 40, further comprising a mesh barrier rib structure formed on said second substrate for separating said display cells.

47. The plasma display panel according to claim 40, wherein in said scan electrode and sustain electrode, a region at least 10 $\mu$m apart from the side end of said scan electrode and sustain electrode facing the discharge gap is made of one selected from the group consisting of an indium tin oxide film, a NESA film, a Cr film, and a Cu film.

48. A plasma display, comprising a plasma display panel according to claim 40.

49. A plasma display panel, comprising:

first and second substrates placed opposed to each other;

a plurality of scan electrodes and common electrodes provided on the surface side of said first substrate facing said second substrate and extending in a first direction; and a plurality of data electrodes provided on the surface side of said second substrate facing said first substrate and extending in a second direction orthogonal to said first direction, a display cell being provided each at the crossing point of said scan electrode and common electrode and said data electrode, driving voltage increased with time being applied to said scan electrode in a priming period, said scan electrode and common electrode comprising a transparent electrode, a first bus electrode formed on the transparent electrode more on the non-discharge gap side than the center thereof and a second bus electrode formed on said transparent electrode more on the discharge gap side than the center thereof, extending in said first direction and shielding light emitted in said display cell by said applied driving voltage, said second bus electrode being thinner than said first bus electrode.

50. The plasma display panel according to claim 49, wherein said bus electrode has a thickness of at least 5 $\mu$m.

51. The plasma display panel according to claim 49, wherein said bus electrode has a black first electrode formed on said transparent electrode, and a second electrode formed on the first electrode and containing Ag.

52. The plasma display panel according to claim 49, wherein in a sustaining period, sustaining pulses in phase are applied to one of said scan electrodes and common electrodes between adjacent display cells in said second direction, and interlace display is provided.

53. The plasma display panel according to claim 49, wherein the relative positional relation between said scan electrodes and said common electrodes is reversed between adjacent cells in said second direction.

54. The plasma display panel according to claim 49, further comprising a mesh barrier rib structure formed on said second substrate for separating said display cells.

55. The plasma display panel according to claim 49, further comprising a mesh barrier rib structure formed on said second substrate for separating said display cells.

56. The plasma display panel according to claim 49 wherein in said scan electrode and sustain electrode, a region at least 10 $\mu$m apart from the side end of said scan electrode and sustain electrode facing the discharge gap is made of one selected from the group consisting of an indium tin oxide film, a NESA film, a Cr film, and a Cu film.

57. A plasma display, comprising a plasma display panel according to claim 49.

* * * * *